US010465417B2

(12) United States Patent
Farag et al.

(10) Patent No.: US 10,465,417 B2
(45) Date of Patent: Nov. 5, 2019

(54) HOUSING FOR REMOVABLE LOCK CORE

(71) Applicant: Spectrum Brands, Inc., Middleton, WI (US)

(72) Inventors: Hanna O. Farag, Riverside, CA (US); James Lin, Laguna Niguel, CA (US)

(73) Assignee: Spectrum Brands, Inc., Middleton, WI (US)

( * ) Notice: Subject to any disclaimer, the term of this patent is extended or adjusted under 35 U.S.C. 154(b) by 0 days.

(21) Appl. No.: 15/797,856

(22) Filed: Oct. 30, 2017

(65) Prior Publication Data

US 2018/0119448 A1 May 3, 2018

Related U.S. Application Data

(60) Provisional application No. 62/414,271, filed on Oct. 28, 2016.

(51) Int. Cl.

| | |
|---|---|
| ***E05B 9/08*** | (2006.01) |
| ***E05B 17/04*** | (2006.01) |
| ***E05B 27/00*** | (2006.01) |
| ***E05B 29/00*** | (2006.01) |
| ***E05B 63/00*** | (2006.01) |

(52) U.S. Cl.

CPC ..... *E05B 9/084* (2013.01); *E05B 9/086* (2013.01); *E05B 17/041* (2013.01); *E05B 27/005* (2013.01); *E05B 29/004* (2013.01); *E05B 63/0056* (2013.01)

(58) Field of Classification Search

CPC ..... E05B 9/084; E05B 9/086; E05B 17/041; E05B 17/04; E05B 29/004; E05B 27/005; E05B 63/0056

USPC ..... 70/367–371, 379 R, 379 A, 380, 373, 70/375, 337–343, 382–385, 492, 495

See application file for complete search history.

(56) References Cited

U.S. PATENT DOCUMENTS 1,888,954 A * 11/1932 Keil ..... E05B 27/00 29/510
2,255,402 A * 9/1941 Vile ..... E05B 63/0013 70/139
3,059,462 A * 10/1962 Check ..... E05B 27/005 70/384
3,431,757 A * 3/1969 Hideo ..... E05B 27/005 70/383
3,589,153 A * 6/1971 Hill ..... E05B 27/005 70/378

(Continued)

FOREIGN PATENT DOCUMENTS

DE 885 367 C 8/1953
DE 10 2005 042 350 A1 3/2007

(Continued)

OTHER PUBLICATIONS

International Search Report and Written Opinion for Application No. PCT/US2017/059050 dated Feb. 28, 2018.

*Primary Examiner* — Lloyd A Gall
(74) *Attorney, Agent, or Firm* — Merchant & Gould P.C.

(57) ABSTRACT

A housing configured to accept a rekeyable lock core for use in lockable enclosures. The housing is configured to use a lock core that is designed for deadbolt and door lever/knob operation. The housing allows a rekeyable lock cylinder to be used in one's home as well as other enclosure enclosures. A common key may therefore be used for all devices as the lock core is of a rekeyable design.

20 Claims, 19 Drawing Sheets

(56) References Cited

U.S. PATENT DOCUMENTS 3,667,262 A * 6/1972 Hill ..... E05B 27/00 70/341
3,863,476 A * 2/1975 Patriquin ..... E05B 29/00 70/375
4,099,397 A 7/1978 Dauenbaugh
4,254,648 A * 3/1981 Dietrich ..... E05B 11/00 70/380
4,823,571 A * 4/1989 O'Gara ..... E05B 9/084 70/139
5,005,387 A * 4/1991 Cufr ..... E05B 65/0003 70/81
5,038,589 A * 8/1991 Martin ..... E05B 9/084 70/368
5,101,649 A * 4/1992 Duval ..... E05B 9/086 70/369
5,491,993 A * 2/1996 Anderson ..... E05B 9/08 70/367
5,634,359 A * 6/1997 Huebschen ..... E05B 9/086 70/367
5,907,963 A * 6/1999 Myers ..... E05B 9/086 70/371
6,105,405 A 8/2000 Westwinkel
6,718,807 B2 * 4/2004 Andersson ..... E05B 9/086 70/369
6,748,777 B1 * 6/2004 Livingston ..... E05B 9/086 70/369
6,860,131 B2 * 3/2005 Armstrong ..... E05B 27/005 70/383
6,871,520 B2 * 3/2005 Armstrong ..... E05B 27/005 70/383
7,100,408 B2 * 9/2006 Nakasone ..... E05B 9/086 70/367
7,152,442 B2 * 12/2006 Char ..... E05B 9/084 70/107
7,213,429 B2 * 5/2007 Armstrong ..... E05B 27/005 70/383
7,234,331 B2 * 6/2007 Armstrong ..... E05B 27/005 70/383
7,762,111 B2 7/2010 Damikolas et al.
7,895,866 B2 3/2011 Damikolas et al.
8,091,393 B2 1/2012 Damikolas et al.
8,584,495 B2 * 11/2013 Chiou ..... E05B 9/084 70/367
8,739,584 B2 * 6/2014 Kargilis ..... E05B 9/084 70/208
9,010,163 B2 * 4/2015 Romero ..... E05B 27/0003 70/367
2005/0193786 A1 9/2005 Nakasone
2009/0241620 A1 * 10/2009 Field ..... E05B 27/0035 70/360

FOREIGN PATENT DOCUMENTS

DE 10 2006 061 224 B3 1/2008
EP 1 842 987 A1 10/2007
EP 3 042 808 A1 7/2016
FR 2 954 385 A1 6/2011

* cited by examiner

HOUSING FOR REMOVABLE LOCK CORE

CROSS-REFERENCE TO RELATED APPLICATION

The present application claims the benefit of U.S. Provisional Patent Application Ser. No. 62/414,271, filed Oct. 28, 2016, which application is hereby incorporated by reference in its entirety.

TECHNICAL FIELD

The present invention relates to lock cores. More particularly it relates to a housing for accepting a standardized lock core for multiple applications.

BACKGROUND OF INVENTION

Lock cylinders that can be rekeyed are known and described in U.S. Pat. Nos. 6,860,131; 7,234,331; 7,213,429; and 6,871,520, the entire contents of which are expressly incorporated by reference herein. These lock cylinders have enjoyed great success in the home-use market.

What is now desirable is to be able to apply these lock cylinders to other markets such as desks, drawers, cabinets, chests, and the like. What is also desirable is to be able to implement these lock cylinders into other markets without requiring a substantial modification to the lock cylinder. In other words, a retrofittable housing capable of receiving the existing lock cylinder in these new markets is therefore desired.

SUMMARY

In one example of the present disclosure, a lock core assembly is disclosed. The lock core assembly includes a body that includes an enclosure mounting interface. The body has a first portion that extends to a first side of the enclosure mounting interface and a second portion that extends to a second side of the enclosure mounting interface opposite the first side. The body defines a housing bore that has an opening defined in the body at the first side. The housing bore further includes lock core retaining features defined therein. The lock core assembly includes a lock core removably positioned within the housing bore and mated with the lock core retaining features. The lock core retaining features are sized and shaped to prevent relative rotation between at least a portion of the lock core and the body. The lock core further includes a rotatable housing interface. The lock core assembly includes a lock core interface positioned within the housing bore. The lock core interface is removably coupled with the housing interface of the lock core. The lock core assembly includes a locking mechanism interface positioned at the second side of the body and in rotational communication with the lock core interface. The locking mechanism interface is positioned at an exterior of the housing bore and is configured to be coupled with a locking mechanism. The housing interface of the lock core is rotationally coupled to the locking mechanism interface by way of the lock core interface.

In another example of the present disclosure, an enclosure is disclosed. The enclosure includes a first body selectively coupled to a second body. The enclosure includes a housing coupled to at least one of the first body and the second body. The housing includes a body that includes an enclosure mounting interface. The body has a first portion that extends to a first side of the enclosure mounting interface and a second portion that extends to a second side of the enclosure mounting interface opposite the first side. The body defines a housing bore that has an opening defined in the body at the first side. The housing bore further includes lock core retaining features defined therein. The housing includes a lock core interface positioned within the housing bore. The housing includes a locking mechanism interface positioned at the second side of the body and in rotational communication with the lock core interface. The locking mechanism interface is positioned at an exterior of the housing bore. The enclosure further including a locking mechanism coupled to the locking mechanism interface. The locking mechanism has a locked position and an unlocked position. When in the locked position, the first body is coupled to the second body by way of the locking mechanism, and, when in the unlocked position, the first body and the second body are at least partially uncoupled by way of the locking mechanism. The enclosure includes a lock core removably positioned within the housing bore and mated with the lock core retaining features. The lock core retaining features are sized and shaped to prevent relative rotation between at least a portion of the lock core and the housing body. The lock core includes a rotatable housing interface and the housing interface of the lock core is removably coupled with the lock core interface of the housing. The housing interface of the lock core is rotationally coupled to the locking mechanism interface by way of the lock core interface. Rotation of the lock core housing interface cycles the locking mechanism between the unlocked position and the locked position.

In another example of the present disclosure, a housing for a lock core is disclosed. The housing including includes a body that includes an enclosure mounting interface. The body has a first portion that extends to a first side of the enclosure mounting interface and a second portion that extends to a second side of the enclosure mounting interface opposite the first side. The body defines a housing bore that has an opening defined in the body at the first side. The housing bore further includes lock core retaining features defined therein. At least one of the lock core retaining features is a slot defined by a wall of the housing bore. The lock core retaining features are sized and shaped to mate with a lock core to prevent relative movement between at least a portion of the lock core and the body. The housing includes a clip removably secured within the slot. The clip is at least partially positioned within the housing bore. The clip is positioned generally perpendicular to the housing bore axis. The housing includes a lock core interface positioned within the housing bore. The housing includes a locking mechanism interface positioned at the second side of the body and in rotational communication with the lock core interface. The locking mechanism interface is positioned at an exterior of the housing bore. The locking mechanism interface is configured to be coupled with a locking mechanism.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The present disclosure will be described hereafter with reference to the attached drawings which are given as non-limiting examples only, in which.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION

In accordance with aspects of the present disclosure, a housing configured to accept a rekeyable lock core for use in lockable enclosures is provided. The housing is configured to use a lock core that is designed for deadbolt and door lever/knob operation. The housing allows a rekeyable lock cylinder to be used in one's home as well as other enclosures. According to example applications of such a housing, a common key may therefore be used for all devices (both deadbolt and door locks as well as on freestanding lockable enclosures) because the lock core is of a rekeyable design.

Figure 1A:
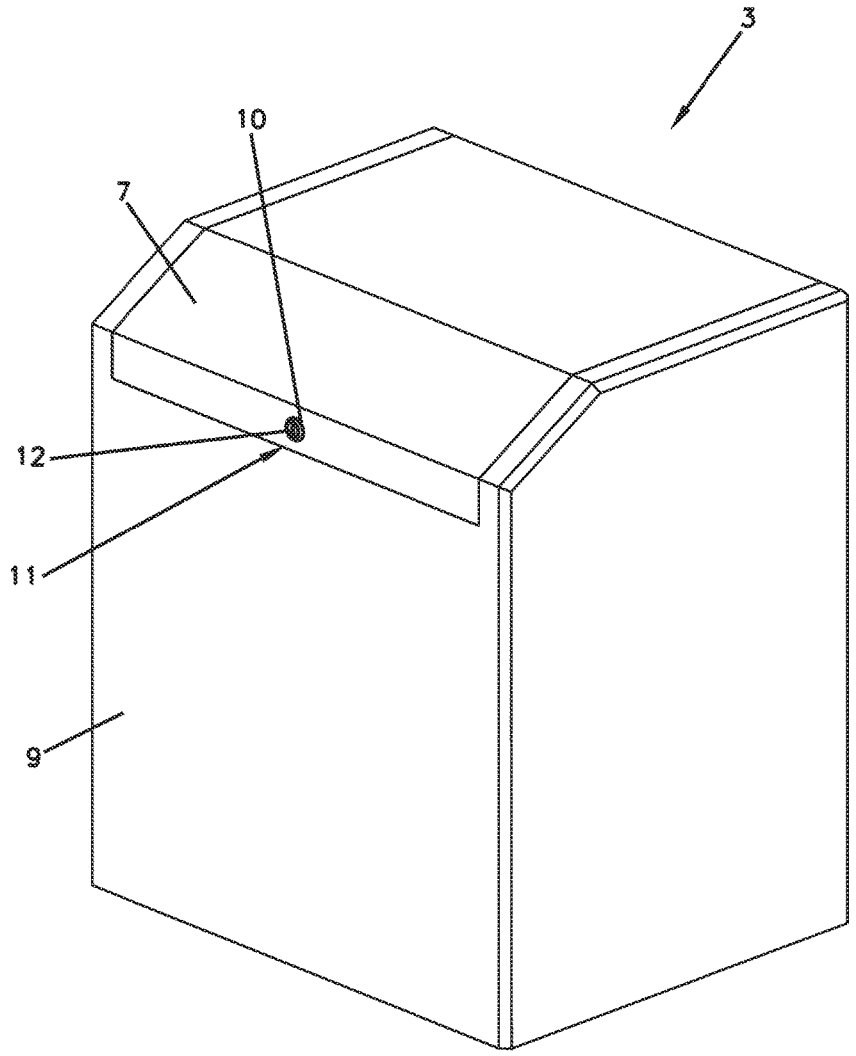
FIG. 1*a* is a perspective view of an enclosure in a locked position, according to one embodiment of the present disclosure.
Figure 1B:
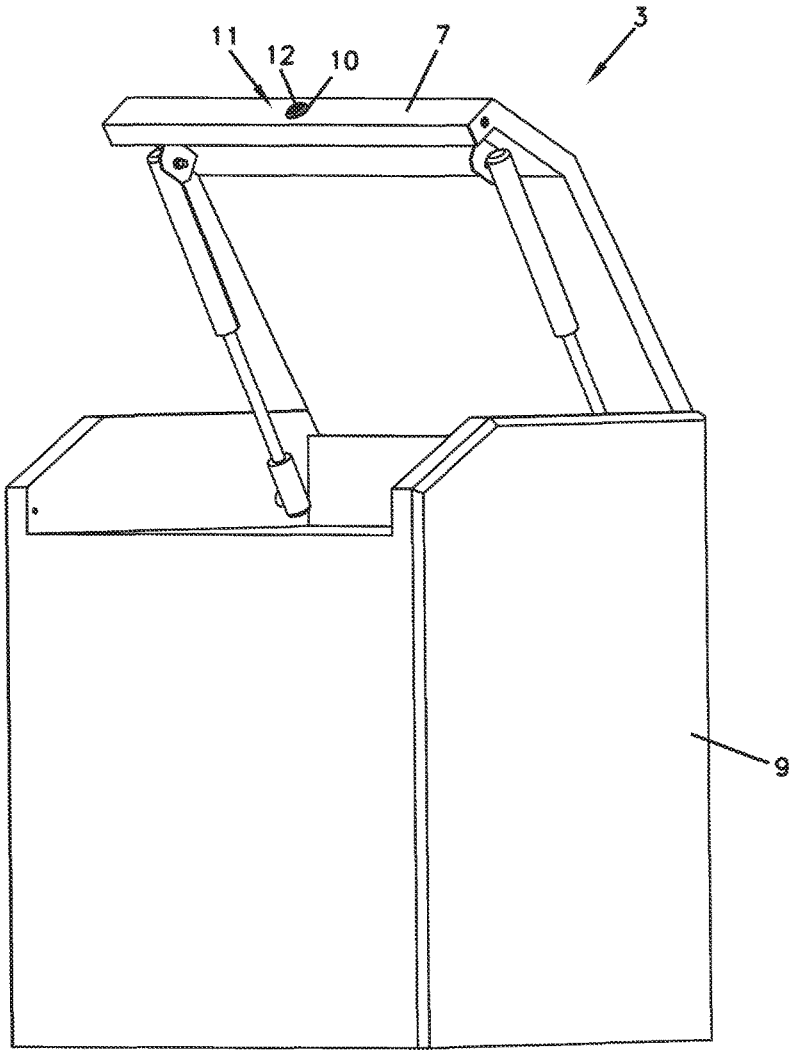
FIG. 1*b* is a perspective view of the enclosure of FIG. 1*a* in an unlocked position.
Figure 1C:
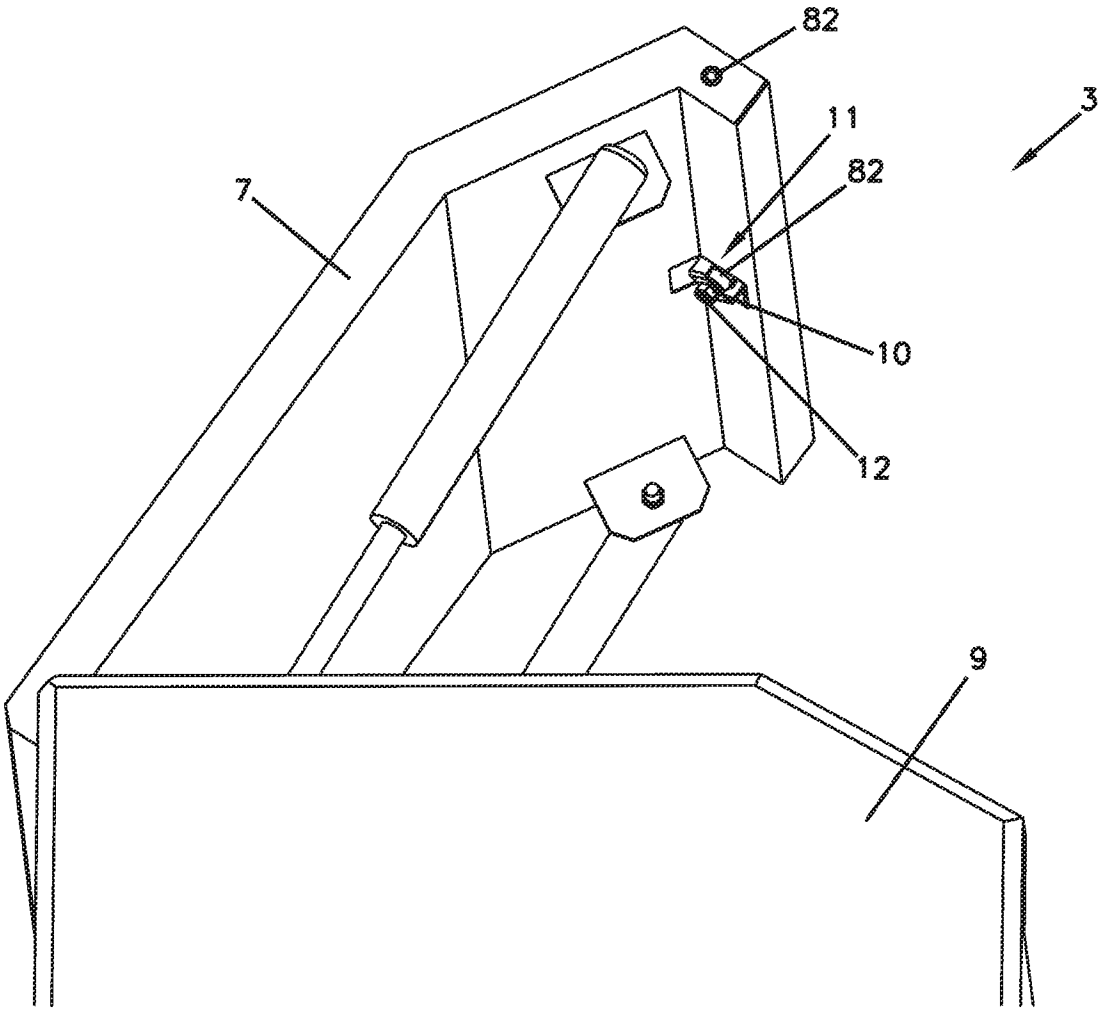
FIG. 1*c* is a perspective side view of the enclosure of FIG. 1*a* in an unlocked position.

FIG. 1*a* shows an enclosure 3 having a first body 7 connected to a second body 9. FIG. 1*a* shows the enclosure 3 in a locked position where the first body 7 is locked to the second body 9 by way of a lock core assembly 11. FIG. 1*b* shows the enclosure 3 in an unlocked position where the first body 7 is unlocked from the second body 9. FIG. 1*c* shows a side view of the enclosure 3 in the unlocked position.

A housing 10 is shown mounted within the enclosure. The housing 10 contains a lock core 12 positioned therein. The lock core 12 is configured to lock and unlock the second body 9 from the first body 7 via a locking mechanism 82. While shown positioned within the first body 7, in some examples, the housing 10 and lock core 12 are positioned within the second body 9 to lock the second body 9 to the first body 7. In some examples, the lock core 12 is removably positioned within the housing 10.

In some examples, the, lock core 12 is configured to be rekeyed in accordance with U.S. Pat. Nos. 6,860,131; 7,234,331; 7,213,429; and 6,871,520, previously incorporated herein by reference. In some examples, the lock core 12 is of the same design as used in deadbolts and door handles/levers.

The housing 10 allows for the same lock core 12 that is used in deadbolts and door handles/levers to be used in the enclosure 3, specifically within the first body 7 and/or second body 9 to secure the first body 7 to the second body 9. In some examples, this allows an operator to use a single key to unlock their home and then use the same key to unlock the lock core 12 positioned within the enclosure 3. In some examples, the enclosure 3 is a desk, a drawer, a cabinet, a chest, tool box, or like enclosure.

Figure 2:
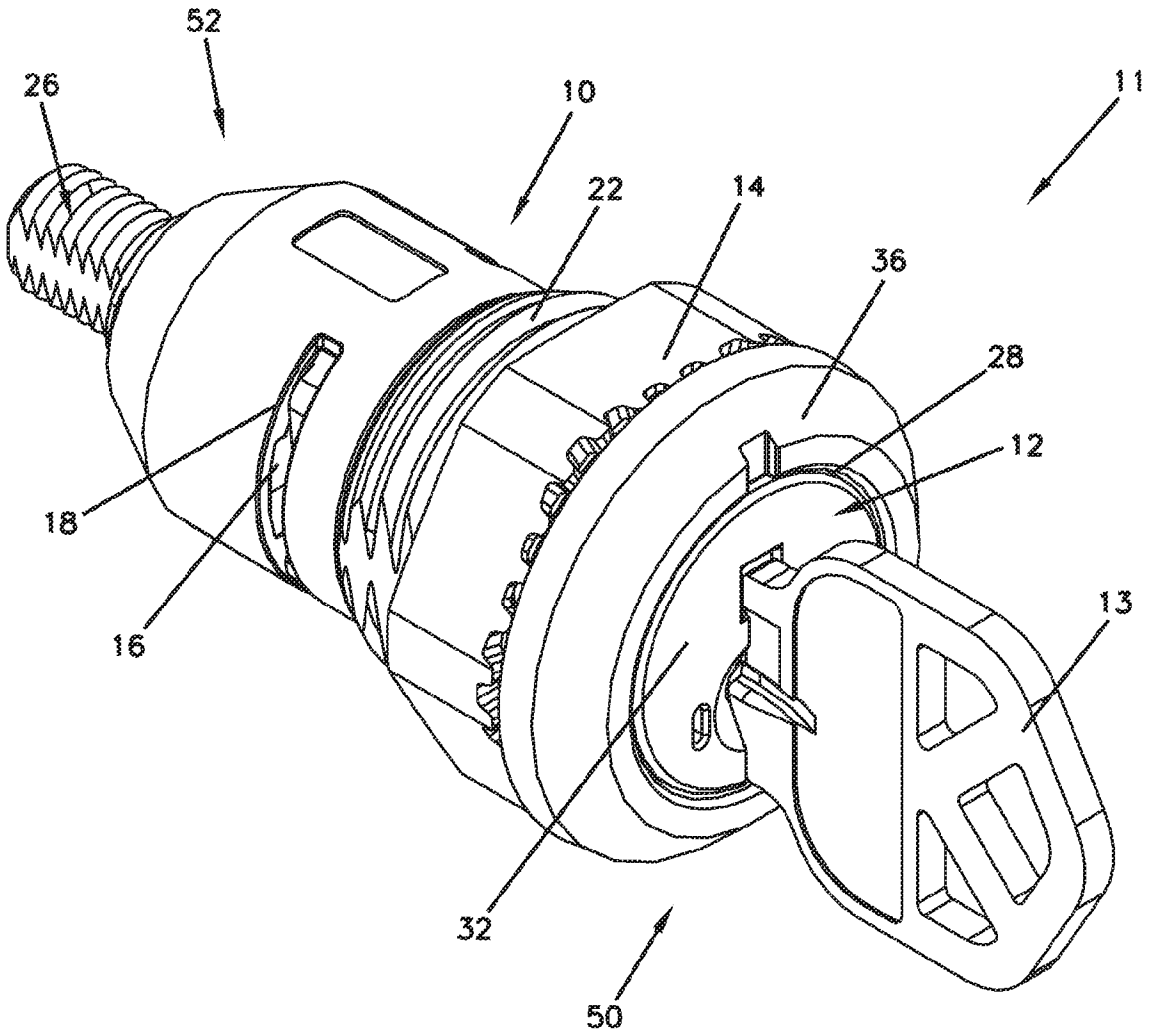
FIG. 2 is a front perspective view of a lock core assembly, according to one embodiment of the present disclosure.
Figure 3:
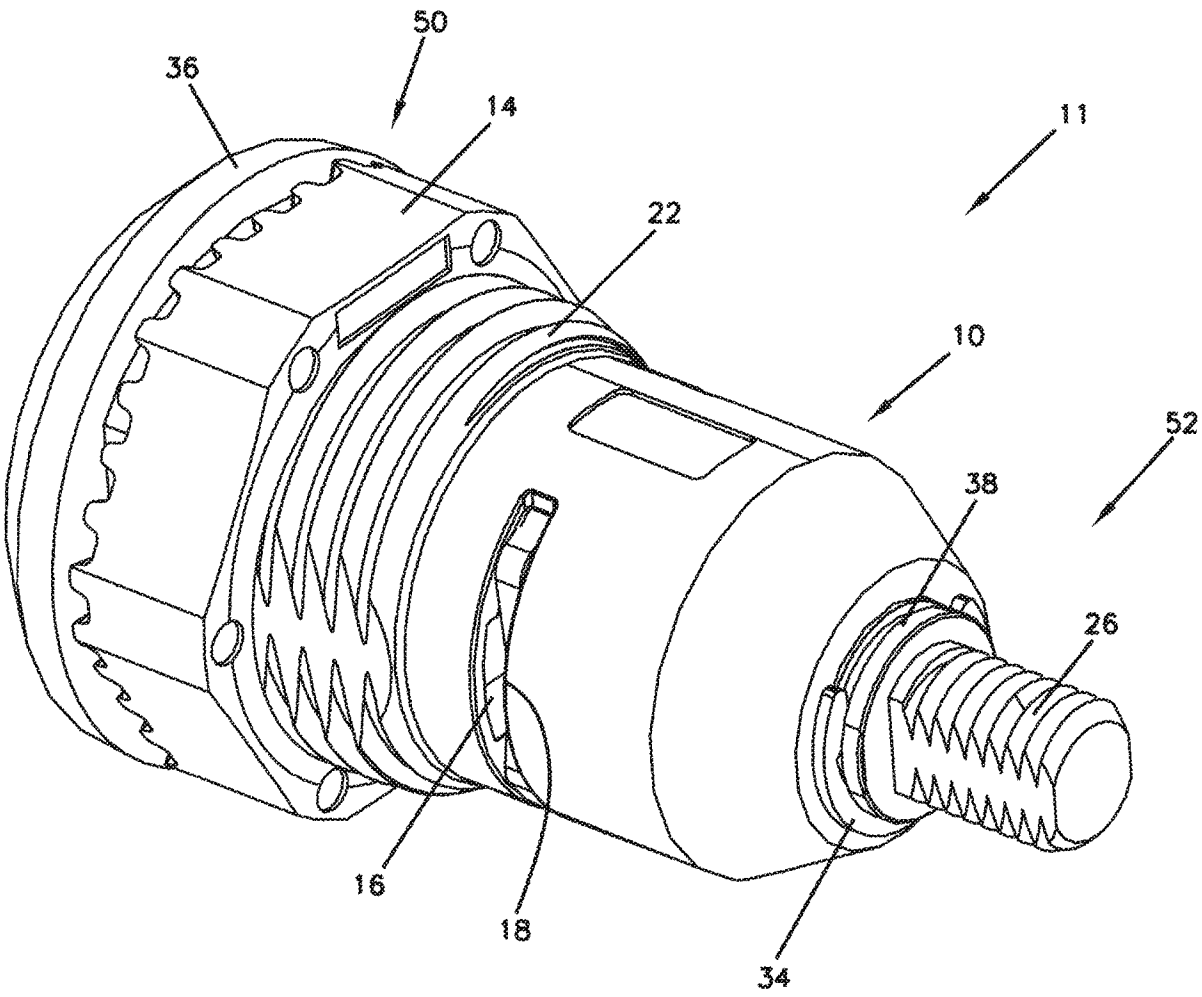
FIG. 3 is a rear perspective view of the lock core assembly of FIG. 2.

FIGS. 2 and 3 show perspective views of the lock core assembly 11. The lock core assembly 11 includes the lock core 12 positioned within the housing 10. A retainer nut 14 is shown removably positioned around the housing 10, and a retainer clip 16 is shown positioned within a slot 18 in the housing 10.

The housing 10 includes a bezel 36 at a first end 50 and a locking mechanism interface 26 at a second end 52. The housing 10 further includes a housing bore 28 that is configured to receive the lock core 12.

The bezel 36 is a flange that is configured to contact a portion of the enclosure 3, such as an exterior face of the first or second body 5, 7. The bezel 36 can be of a variety of different shapes and sizes to fit or match with a variety of different enclosures 3. In some examples, the bezel 36 is rectangular. In some examples, the bezel 36 can overlap the enclosure 3 exterior such that the bezel 36 surrounds a hole formed in the exterior of the enclosure within which the housing 10 can be positioned.

The locking mechanism interface 26 is configured to mate with the locking mechanism 82 to facilitate the locking and unlocking of the enclosure 3. In some examples, the locking mechanism interface 26 is configured to engage a locking mechanism commonly found on desks, drawers, cabinets, chests, tool boxes, etc. The locking mechanism interface 26 is rotatable with rotation of the lock core 12. In some examples, the locking mechanism interface 26 is threaded. In some examples, the locking mechanism interface 26 is a threaded, generally cylindrical stud. In some examples, the locking mechanism interface 26 is configured to receive a pin or like fastener. In some examples, the locking mechanism interface 26 includes a recess to receive a locking mechanism. In some examples, the locking mechanism interface 26 is polygonal. In other examples, the locking mechanism interface 26 includes lobes or other non-polygonal, non-cylindrical shapes.

With continued reference to FIG. 3, the locking mechanism interface 26 can be disposed on an adapter 25 removably coupled to the second end 52 of the housing 10. In some examples, the adapter 25 has a groove 38 that is configured to receive a c-clip 34 to secure the adapter 25 to the housing 10.

In some examples, the housing bore 28 has a profile that matches the profile of the lock core 12 so that the lock core 12 can be removably positioned within the housing bore 28. In other examples, the housing bore 28 has a mismatched profile from that of the lock core 12. In such an example, the housing bore 28 can be configured to still receive the lock core 12 (for example, via an adaptor or a specialty flange). In some examples, the housing bore 28 has a cylindrical shape. In other examples, the housing bore 28 has a non-cylindrical shape. For example, the housing bore 28 can be rectangularly shaped.

The lock core 12 is configured to receive a key 13. As noted above, the lock core 12 is configured to be rekeyable and positionable within the housing bore 28 of the housing 10. In some examples, upon insertion of the correct key, at least a portion of the lock core 12 is rotatable with respect to the housing bore 28 to rotate the locking mechanism interface 26, thereby actuating a locking mechanism 82 attached to the locking mechanism interface 26 between a locked and unlocked position. The lock core 12 has an outer housing 45 (shown in FIG. 4) that can have a variety of different shapes. In some examples, the outer housing 45 can have a generally cylindrical shape. In some examples, the outer housing 45 can have a generally polygonal shape.

The retainer nut 14 can be engaged with housing threads 22 at an exterior of the housing 10. In some examples, the retainer nut 14 includes nut thread 24 that engages with the housing threads 22. The retainer nut 14 is configured to engage an interior of the first or second body 7, 9 of the enclosure 3. Specifically, the retainer nut 14 can be threaded to the housing thread 22 so that a portion of the first or second body 7, 9 is positioned between the retainer nut 14 and the bezel 36. Such positioning secures the housing 10 to the enclosure 3. In some examples, the housing 10 can be configured for use with a variety of enclosures 3 having differing wall thicknesses. As shown, the retainer nut 14 can be adjusted along the housing thread 22 to account for a variety of different wall thicknesses.

The clip 16 is removably positioned within the slot 18 of the housing 10. The clip 16 is configured to secure the lock core 12 within the housing bore 28. Specifically, the clip 16 prevents the lock core 12 from moving longitudinally within the housing bore 28. In some examples, the clip 16 is configured to contact the lock core 12.

Figure 4:
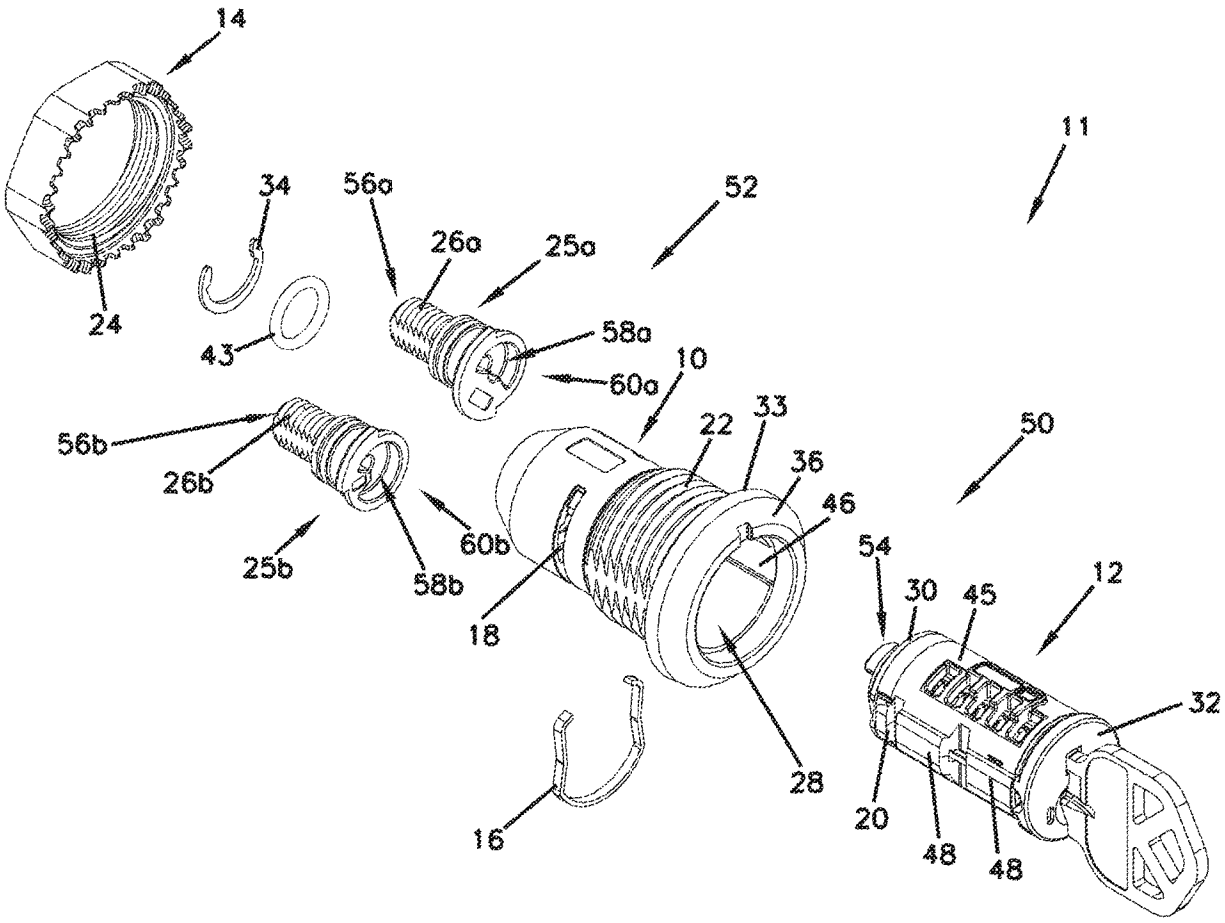
FIG. 4 is an exploded view of the lock core assembly of FIG. 2 showing optional adapters.

FIG. 4 shows an exploded view of the lock core assembly 11. An adapter 25*a* and an alternative adapter 25*b* are shown. Both adapters 25*a*, 25*b* include the locking mechanism interfaces 26*a*, 26*b* at first ends 56*a*, 56*b*, and a lock core interface 58*a*, 58*b* at second ends 60*a*, 60. The lock core interfaces 58*a*, 58*b* are configured to mate with a housing interface 54 of the lock core 12. Only a single adapter 25*a*, 25*b* is coupled with the housing 10 at a time. As depicted, the lock core interfaces 58*a*, 58*b* differ between adapters 25*a*, 25*b*, and each lock core interface 58*a*, 58*b* limits the rotation of the locking mechanism interface 26*a*, 26*b* of each adapter 25*a*, 25*b*. In some examples, the lock core interface 58*a* allows the locking mechanism interface 26*a* to rotate within a greater range of degrees than the locking mechanism interface 26*b*.

The c-clip 34 and an O-ring 43 are also shown. The O-ring 43 and c-clip 34 aid in coupling the adapters 25 to the housing 10.

As shown, the housing bore 28 includes at least one lock core retaining feature 46. In some examples, the lock core retaining feature 46 is a receiver slot disposed within the housing bore 28. In some examples, a similar receiver slot is located on the opposing side of the housing bore 28. The lock core retaining features 46 match the profile of the outer housing 45 of the lock core 12. Specifically, the outer housing 45 includes a pair of bar protrusions 48 extending from the outer housing 45. The bar protrusions 48 are inserted into the lock core retaining features 46 within the housing 10, specifically the housing bore 28, to prevent the lock core 12, specifically the outer housing 45, from rotating once inserted within. While the outer housing 45 is prevented from rotating relative to the housing 10, a lock core front face 32 and the housing interface 54 of the lock core 12 can rotate relative to the housing 10.

A receiving notch 20 disposed on the outer housing 45 of the lock core 12 is configured to receive the retainer clip 16. Specifically, once the lock core 12 is positioned within the housing bore 28, the clip 16 is inserted into the slot 18 on the housing 10 to engage the receiving notch 20 of the lock core 12. Once the retainer clip 16 is mated with the receiving notch 20, the lock core 12 may not be pulled out of the housing 10.

In order to separate the lock core 12 from the housing 10, an operator requires access to the rear of the housing 10 (i.e., the portion of the housing between a back side 33 of the bezel 36 and the second end 52 of the housing 10) in order to remove the retainer clip 16 from the slot 18. In such an event, such access to the clip 16 would require the first and second bodies 7, 9 to be unlocked from one another (i.e., the lock core 12 would be in an unlocked configuration). If, however, the lock core 12 is in a locked configuration, the operator would not have access to the retainer clip 16 as it would be within the locked and secured portion of the enclosure 3. As a result, only operators that have the ability to lock and unlock the lock core 12 are able to remove the lock core 12 from the housing 10.

When assembling the lock core 12 and housing 10 in the enclosure 3, the locking mechanism interface 26 on the housing 10 is passed through an exterior surface of the enclosure 3 such that the locking mechanism interface 26 penetrates into the enclosure 3. In some examples, a round hole is formed in the exterior of the enclosure 3 allowing insertion of the locking mechanism interface 26 and housing 10. The retainer nut 14 may then be engaged with the enclosure 3 by mating the nut threads 24 of the retainer nut 14 with the housing threads 22 of the housing 10. The retainer nut 14 may then be secured to prevent movement of the housing 10 within the hole formed in the enclosure 3. The lock core 12 (starting with housing interface 54 leading first) may then be inserted into the housing bore 28 such that the bar protrusions 48 align with the lock core retaining features 46 of the housing bore 28. The face 32 may then be pushed into the housing bore 28 until it is flush with the bezel 36. Insertion of the retainer clip 16 into the slot 18 and into the receiving notch 20 may then secure the lock core 12 into the housing 10 and the enclosure 3.

Figure 5:
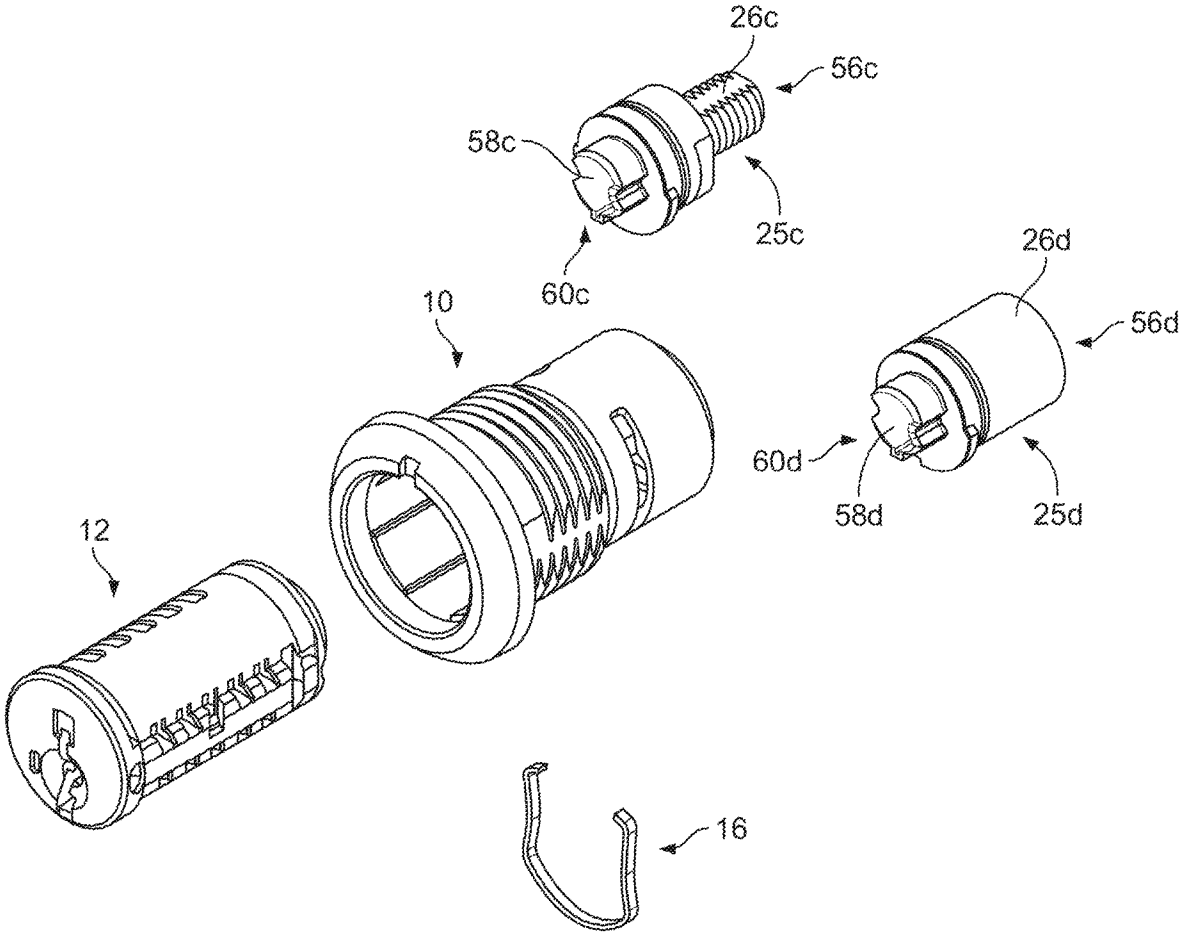
FIG. 5 is another exploded view of the lock core assembly of FIG. 2 showing optional adapters.

FIG. 5 shows an additional exploded view of the lock core 12, housing 10, clip 16, and optional adapters 25*c*, 25*d*. The adapters 25*c*, 25*d* are substantially similar to the adapters 25*a*, 25*b* and each includes the locking mechanism interface 26*c*, 26*d* at first ends 56*c*, 56*d*, and lock core interfaces 58*c*, 58*d* at second ends 60*c*, 60*d*.

Figure 6:
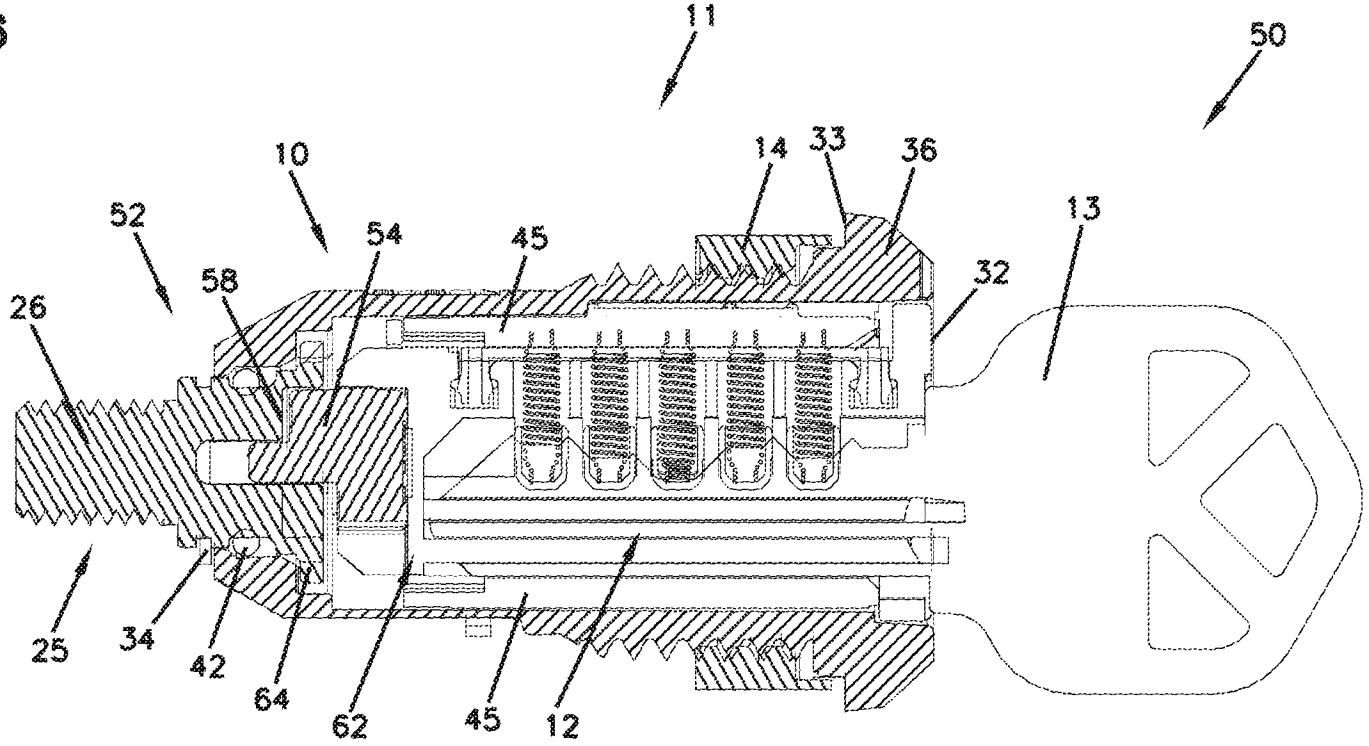
FIG. 6 is a longitudinal cross sectional view of the lock core assembly of FIG. 2.

FIG. 6 shows a cross-sectional view of the lock core assembly 11. As shown, the housing interface 54 of the lock core 12 is coupled within the lock core interface 58 of the adapter 25. In such an arrangement, the housing interface 54, lock core interface 58, and locking mechanism interface 26 are all coupled to transfer rotation therebetween.

The lock core 12 includes an inner assembly 62 that is rotatable with the key 13 (i.e., the keyed key). Upon rotation of the inner assembly 62, the housing interface 54 also rotates within the inner assembly 62.

The adapter 25 is shown coupled with the housing 10 via the c-clip 34 at the exterior of the housing 10 and a flange 64 at the interior of the housing 10. Further, the locking mechanism interface 26 is positioned on the exterior of the housing bore 28 of the housing 10 while the lock core interface 58 is shown positioned to be in communication with the housing bore 28.

In the depicted embodiments, the locking mechanism interface 26 and lock core interface 58 are both disposed on the adapter 25. However, it considered within the scope of the present disclosure that the locking mechanism interface 26 and the lock core interface 58 can be disposed on separate components that are coupled and transfer rotation therebetween. Further, while the lock core interface 58 is shown as a recess and the housing interface 54 is shown as a projection, it is considered within the present disclosure that the interfaces 58, 54 can have a variety of different configurations to allow the interfaces 58, 54 to non-permanently couple and transfer rotation therebetween.

Figure 7:
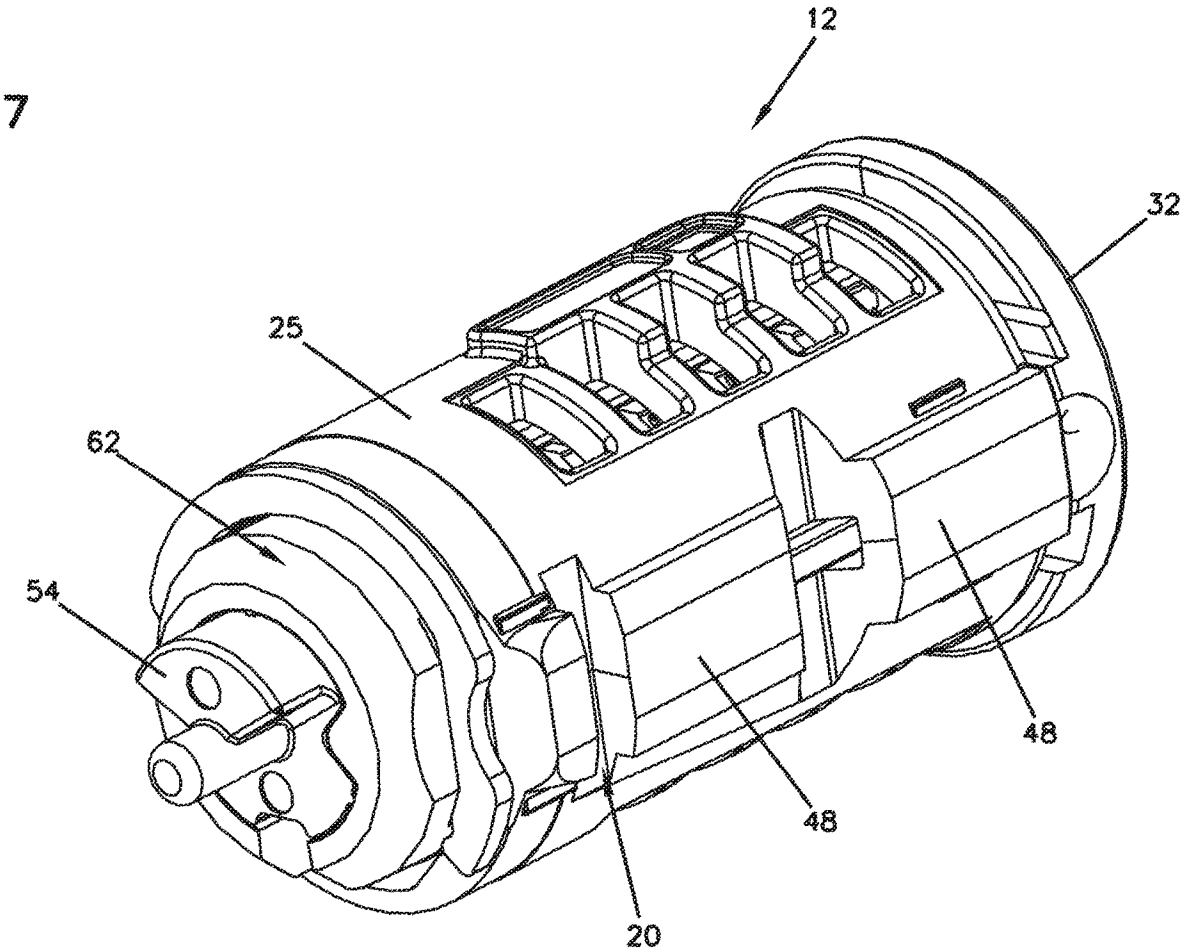
FIG. 7 is a perspective view of a lock core, according to one embodiment of the present disclosure.
Figure 8:
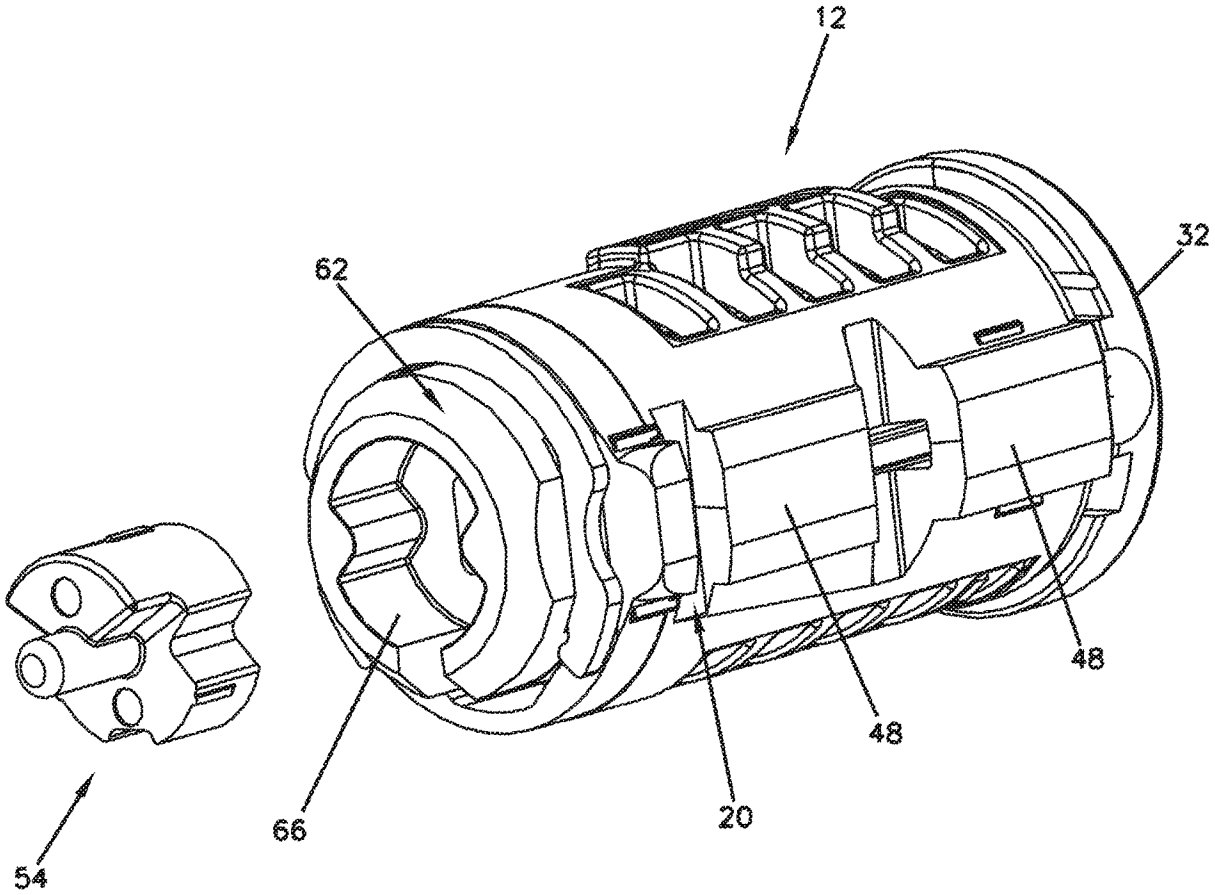
FIG. 8 is a partial exploded view of the lock core of FIG. 7.

FIG. 7 shows the housing interface 54 coupled to the lock core 12. FIG. 8 shows the housing interface 54 removed from the lock core 12. In some examples, the housing interface 54 is press fit within a housing interface recess 66 of the inner assembly 62 of the lock core 12. In other examples, the housing interface 54 can be integral with the inner assembly 62 of the lock core 12. A plurality of different housing interfaces having a variety of different configurations can be used to mate with the housing interface recess 66 of the lock core 12.

In some embodiments, the housing interface 54 is positioned axially with respect to the lock core 12, such that it interfaces with adapters 25 to rotate the locking mechanism interface 26. The housing interface 54, unlike in deadbolt-style or door handle-style housings, allows for connection to such an axially positioned locking mechanism 82, rather than to a perpendicularly arranged deadbolt or other door securing feature. Furthermore, in some embodiments, the housing interface 54 and/or adapters 25 can be sized to have a diameter equal to or smaller than the lock core, and therefore be readily removable upon removal of the clip 16, to allow for simple replacement of the lock core when in an unlocked position as noted herein.

Figure 9:
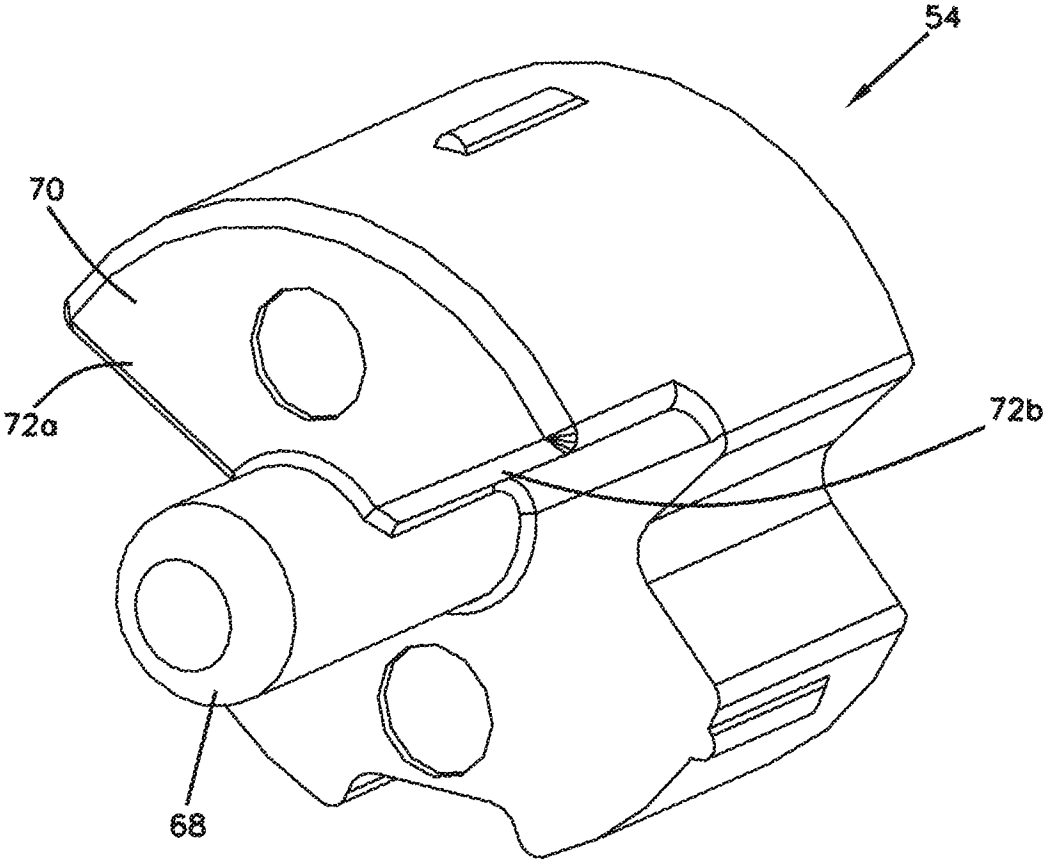
FIG. 9 is a perspective view of a housing interface, according to one embodiment of the present disclosure.
Figure 10:
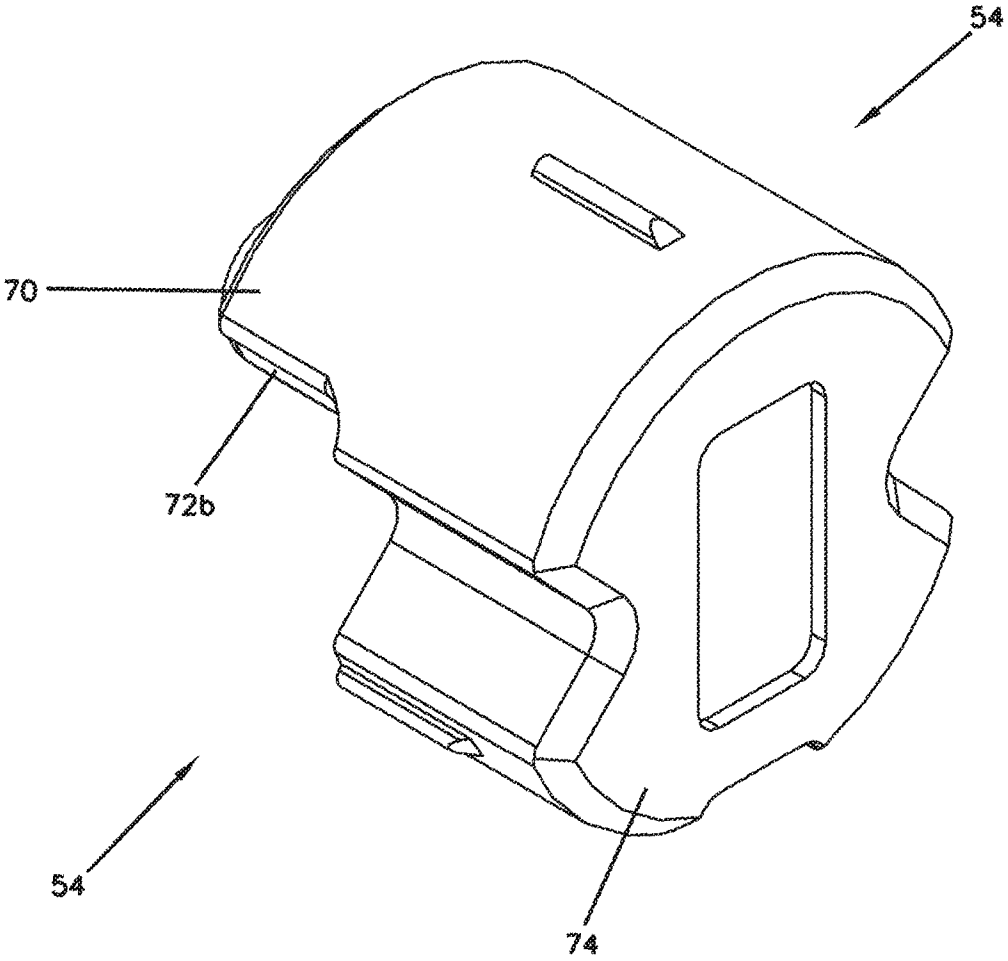
FIG. 10 is another perspective view of the housing interface of FIG. 9.

FIGS. 9 and 10 show perspective views of the housing interface 54. In the depicted examples, the housing interface 54 includes a pair of projections 68, 70. Both projections 68, 70 are configured to mate with the lock core interface 58 of the adapter 25. The projection 68 can be configured to axially align the lock core 12 within the housing 10, specifically the lock core interface 58. In some examples, the projection 68 is a cylindrical projection.

The projection 70 is configured to mate with the lock core interface 58 to transfer rotation there between. In some examples, the projection 70 has torque transfer faces 72*a*, 72*b* that are configured to contact with the lock core interface 54. Specifically, when the housing interface 54 rotates to an unlocked position, only one of the torque transfer faces 72*a*, 72*b* contacts the lock core interface 58. Similarly, when the housing interface 54 rotates to a locked position, only one of the torque transfer faces 72*a*, 72*b* contacts the lock core interface 58.

The housing interface 54 also has a torque transfer rear profile 74. The rear profile 74 can be of any shape so as to mate with the housing interface recess 66 of the inner assembly 62 of the lock core 12 and transfer rotation therebetween. In the depicted example, the rear profile 74 is non-cylindrical.

Figure 11:
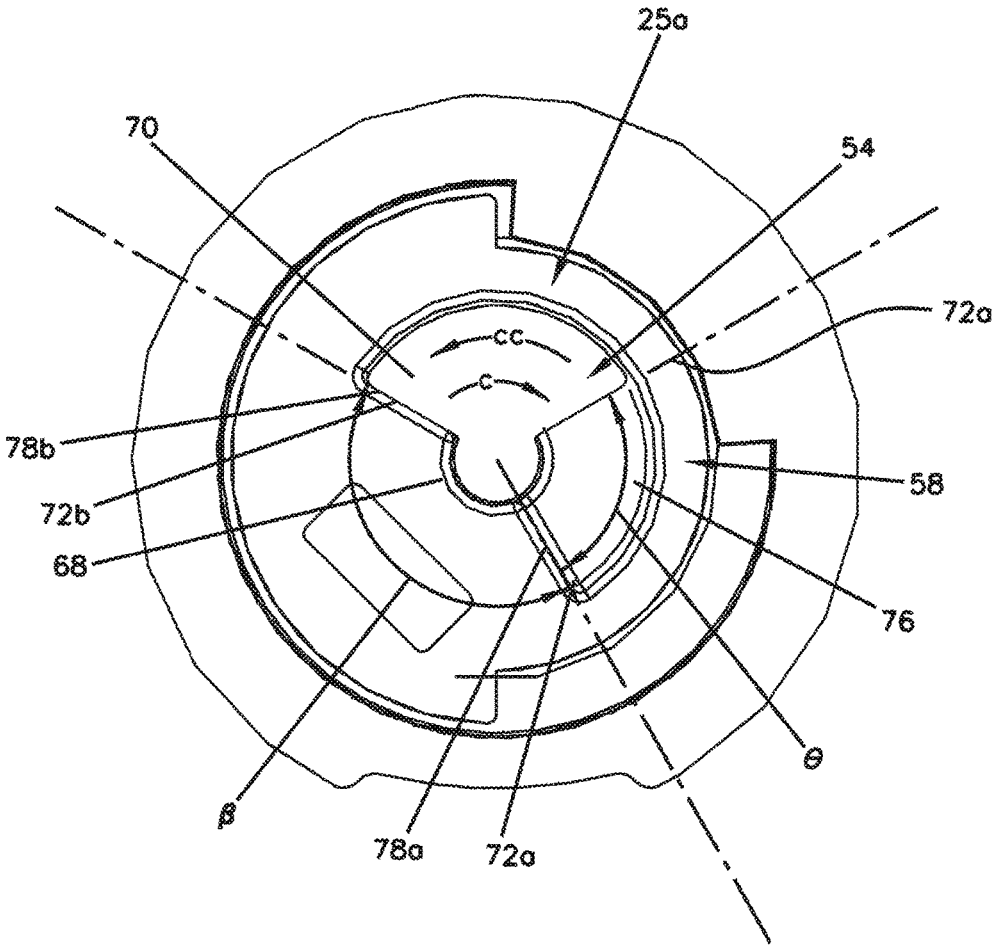
FIG. 11 is a cross sectional view of a housing interface mated with a first lock core interface of an adapter, according to one embodiment of the present disclosure.

FIG. 11 shows a schematic view of a portion of the housing interface 54 mated within the lock core interface 58. Specifically, the projections 68, 70 are shown to be positioned within a lock core interface recess 76. The lock core interface recess 76 is shown to be larger than the projections 68, 70. Specifically, the lock core interface recess 76 is configured to limit the rotation of the adapter 25 while the housing interface 54, and therefore the inner assembly 62 of the lock core 12, are allowed to rotate within normal degree of rotation. In other examples, during the normal rotation cycle the inner assembly 62 rotates less than or equal 360 degrees, for example by rotating about 180 degrees between locked and unlocked positions. In some examples, during the normal rotation cycle the inner assembly 62 rotates about 90 degrees when moved from a locked to an unlocked position.

In the position shown, when the torque transfer face 72*b* is contacting a corresponding face 78*b* of the lock core recess 76 and the housing interface 54 is rotated in a clockwise direction C, the housing interface 54 must be rotated an angle θ before the torque transfer face 72*a* contacts a corresponding face 78*a* within the lock core interface recess 76. Once contact is made between the torque transfer face 72*a* and the corresponding face 78*a*, torque can be transferred therebetween with continued rotation of the housing interface 54. Such is true in the reverse when faces 72*b*, 78*b* are mated and the housing interface 54 is rotated in a counterclockwise direction CC. Similarly, no torque is transferred as the projection 70 is rotated within the recess 76 in either direction within angle θ.

Rotation of the adapter 25 is limited by the recess 76 while inner assembly 62 of the lock core 12 is permitted a normal range of rotation. This creates a turning ratio between the inner assembly 62 of the lock core 12 and the adapter 25. In the depicted example, for every normal rotation cycle of the inner assembly 62, the lock core interface 54 rotates less than the normal rotation cycle of the inner assembly 12. An angle β is shown to represent the actual rotation of the adapter 25. Angle θ and angle β combine to represent the normal rotation cycle of the inner assembly 12. Angle θ and angle β can be customized for a particular application. For example, particular locking mechanisms coupled the locking mechanism interface 26 may require less rotation than the normal rotation cycle of the inner assembly 62 of the lock core 12.

In some examples, the turning ratio (i.e., the ratio between the sum of angle β and angle θ and angle β) of the housing interface 54 and the lock core interface 58 can be 1:1, meaning that, for every degree of rotation the inner assembly 62 is rotated in either a clockwise direction C or counter clockwise direction CC, the adapter 25 is rotated an equal number of degrees. In some examples, the turning ratio between the housing interface 54 and the lock core interface 58 can be 2:1, meaning that, for every degree of rotation the inner assembly 62 is rotated, in either a clockwise direction C or counter clockwise direction CC, the adapter 25 is rotated the half the amount of the degrees. It is considered within the scope of the present disclosure that an infinite number of ratios can be achieved with particular configurations of the projection 70 and the recess 76. In some examples, a transmission (not shown) can be utilized to reverse the turning ratio to allow the lock core interface 58 to rotate a larger amount of the degrees than the housing interface 54 and inner assembly 62 of the lock core 12.

Figure 12:
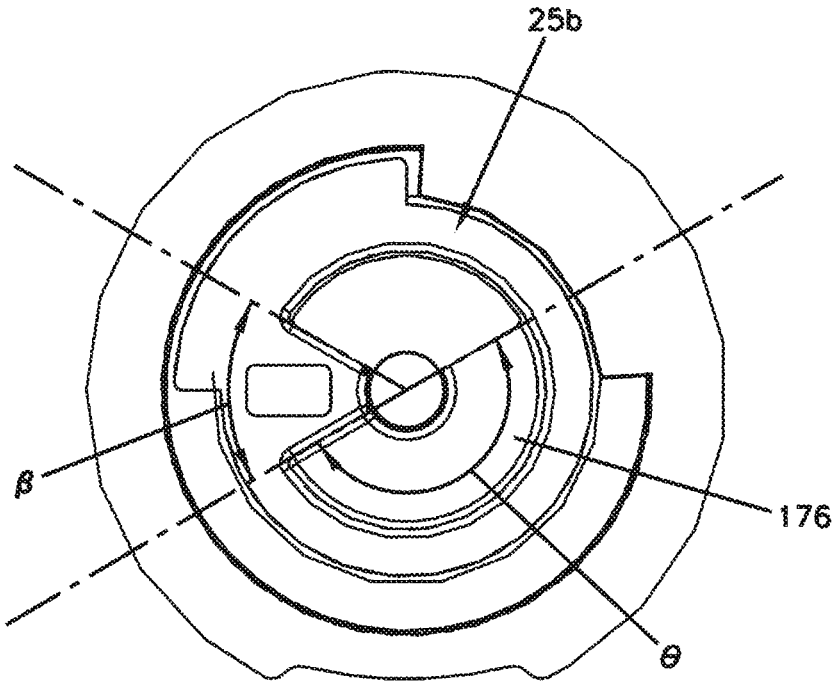
FIG. 12 is a cross sectional view of a housing interface mated with a second lock core interface of an adapter, according to one embodiment of the present disclosure.

FIG. 12 shows the adapter 25*b* having a recess 176 that is larger than the recess 76 described above. In some examples, angle β is equivalent in the adapter 25*a* shown in FIG. 11 to angle β in the adapter 25*b* shown in FIG. 12.

Figure 13:
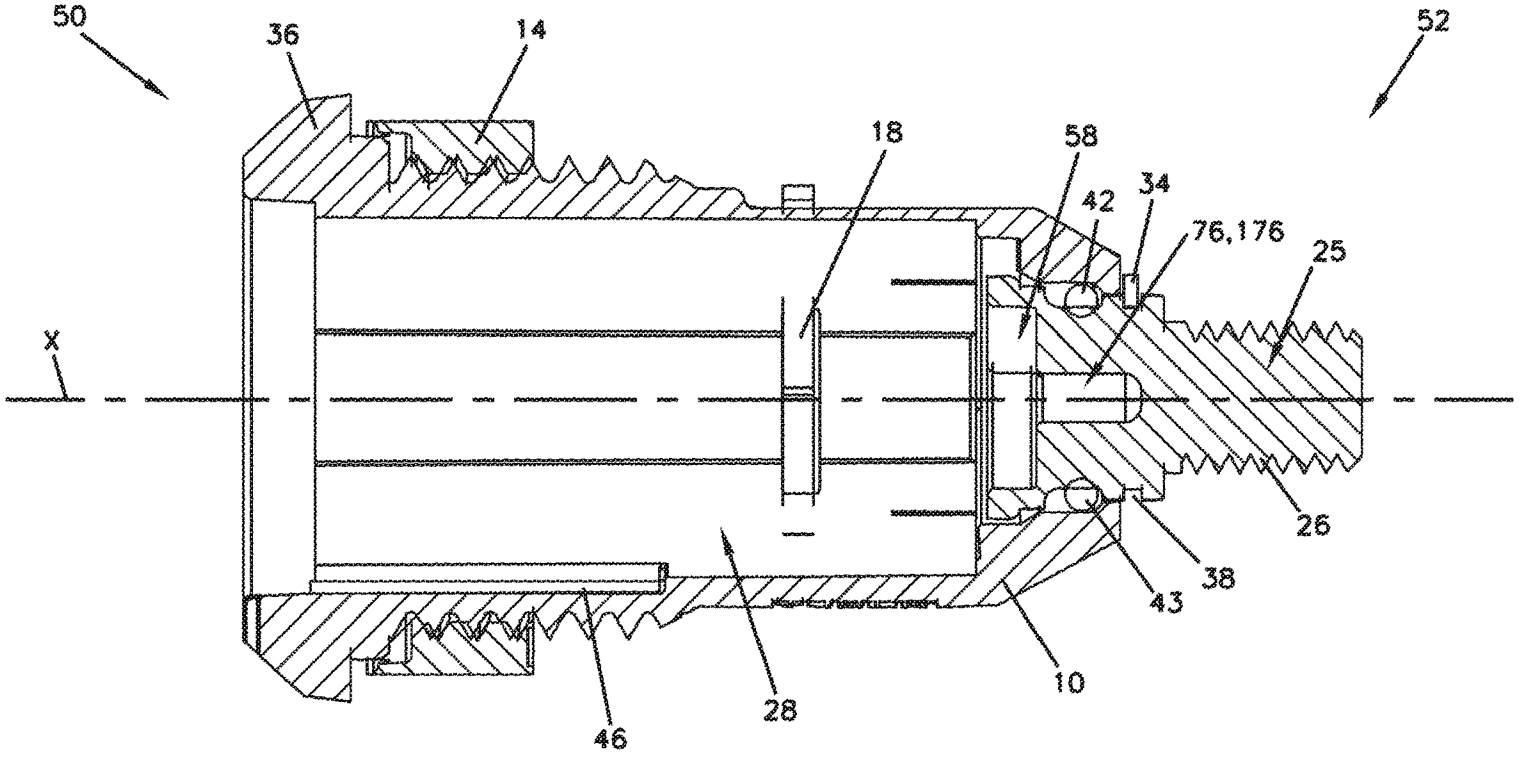
FIG. 13 is a longitudinal cross sectional view of a housing, according to one embodiment of the present disclosure.

FIG. 13 shows a side cross sectional view of the housing 10 and adapter 25 coupled with the housing 10. The adapter 25 can be either adapter 25*a*, 25*b*. The adapter 25 includes the c-clip groove 38 that accepts the c-clip 34. The c-clip 34 retains the adapter 25 at least partially within the housing 10, specifically in communication with the housing bore 28, within the second end 52 of the housing 10. As shown, the lock core interface 58, specifically recess 76 or 176, are in communication with the housing bore 28. The O-ring 43 within an O-ring groove 42 provides an added positive engagement between the adapter 25 and the housing 10 as the adapter 25 is rotated.

FIG. 13 also shows a side view of the lock core retaining feature 46 within the housing bore 28. As shown, the lock core retaining feature 46 is a slot. Further, the housing bore 28 is shown to include a housing bore axis X. The housing bore axis X can be aligned with an axis of rotation of the inner assembly 62 of the lock core 12 and also aligned with an axis of rotation of the adapter 25.

Figure 14:
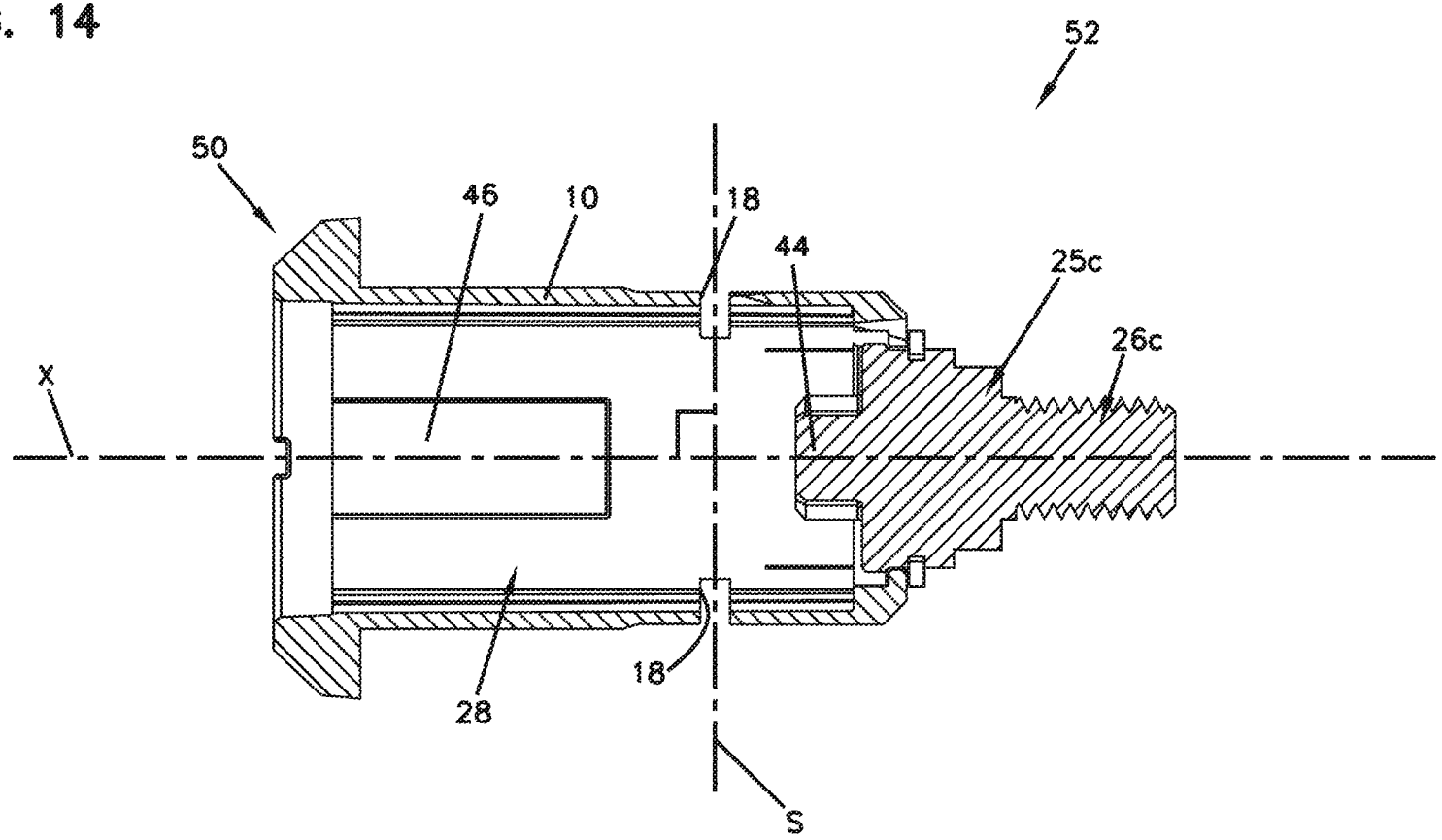
FIG. 14 is a longitudinal cross sectional view of a housing, according to one embodiment of the present disclosure.

FIG. 14 shows the adapter 25*c* coupled with the housing 10. In the depicted example, the adapter 25*c* includes a spline 44. As the lock core 12 is rotated with the key 13, the spline 44 on the adapter 25 is positioned within the housing 10 and is rotated as well. The spline 44 can engage the housing interface recess 66 of the lock core 12 such that, as the inner assembly 62 of lock core 12 is rotated with the key 13, the adapter 26 rotates as well.

FIG. 14 shows the housing bore axis X positioned generally perpendicular to a reference plane S defined by the slot 18. In some examples, the slot 18 can be positioned so that the reference plane S is positioned at a non-perpendicular angle with the housing bore axis X.

Figure 15:
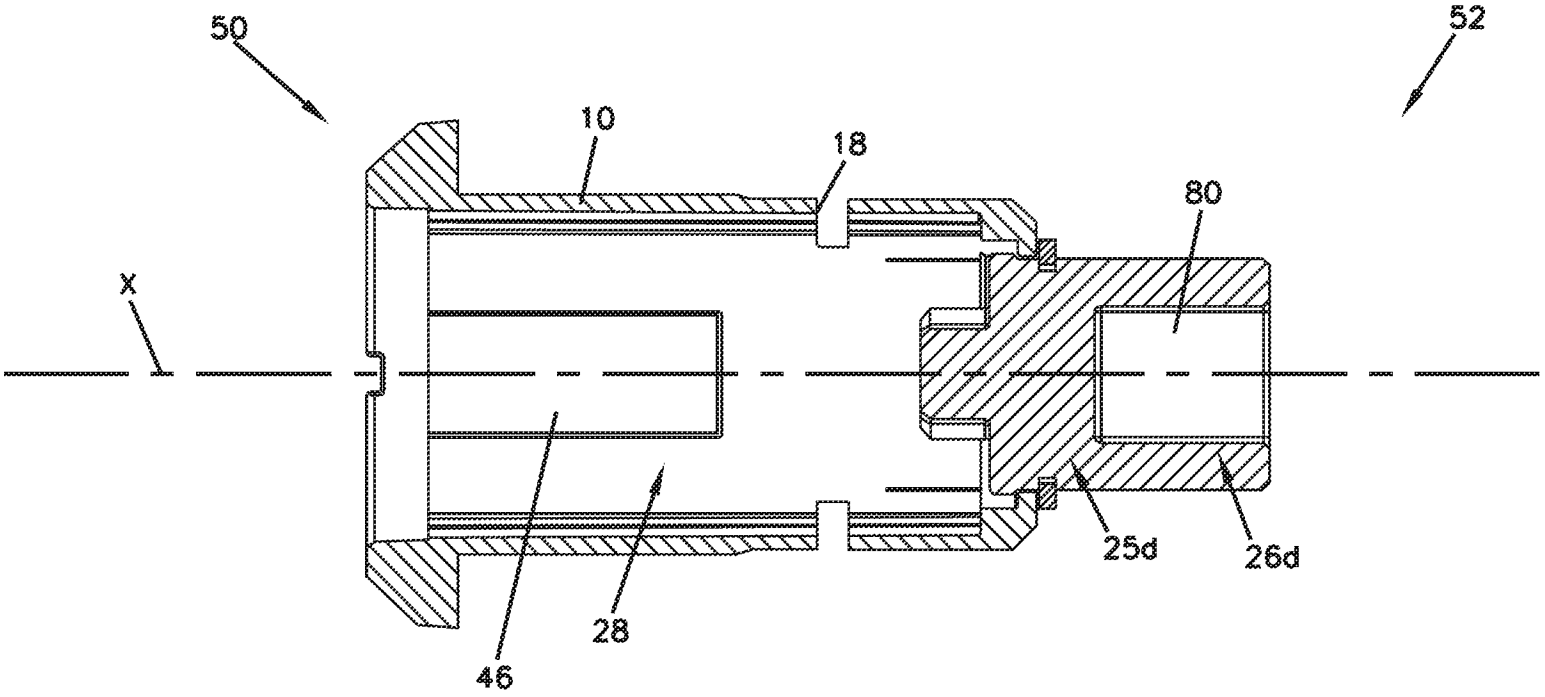
FIG. 15 is a longitudinal cross sectional view of a housing, according to one embodiment of the present disclosure.

FIG. 15 shows the adapter 25*d* coupled with the housing 10. As shown, the locking mechanism interface 26*d* includes a recess 80. The recess 80 can be a variety of different shapes to mate with a variety of different locking mechanisms 82.

Figure 16:
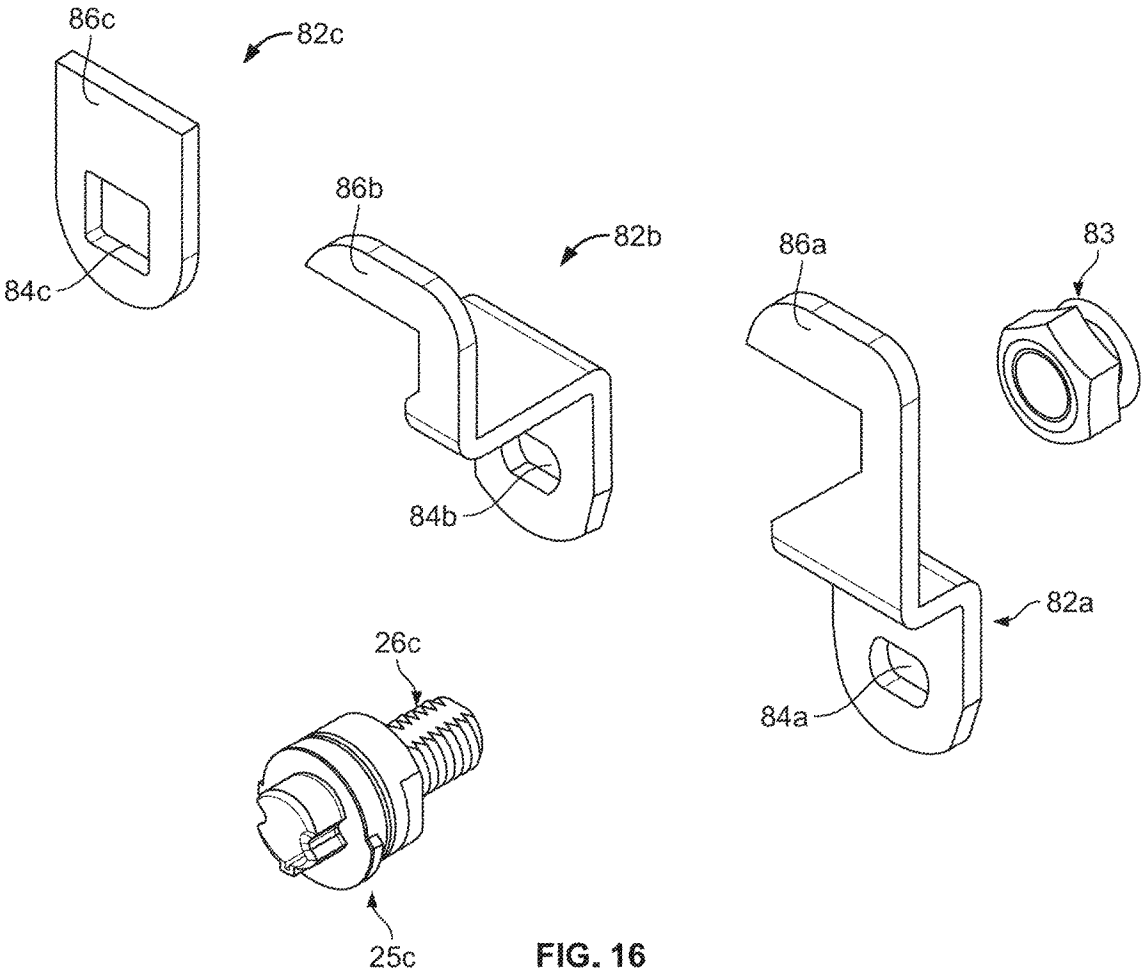
FIG. 16 is a perspective view of an adapter and a plurality of locking mechanisms, according to one embodiment of the present disclosure.
Figure 17:
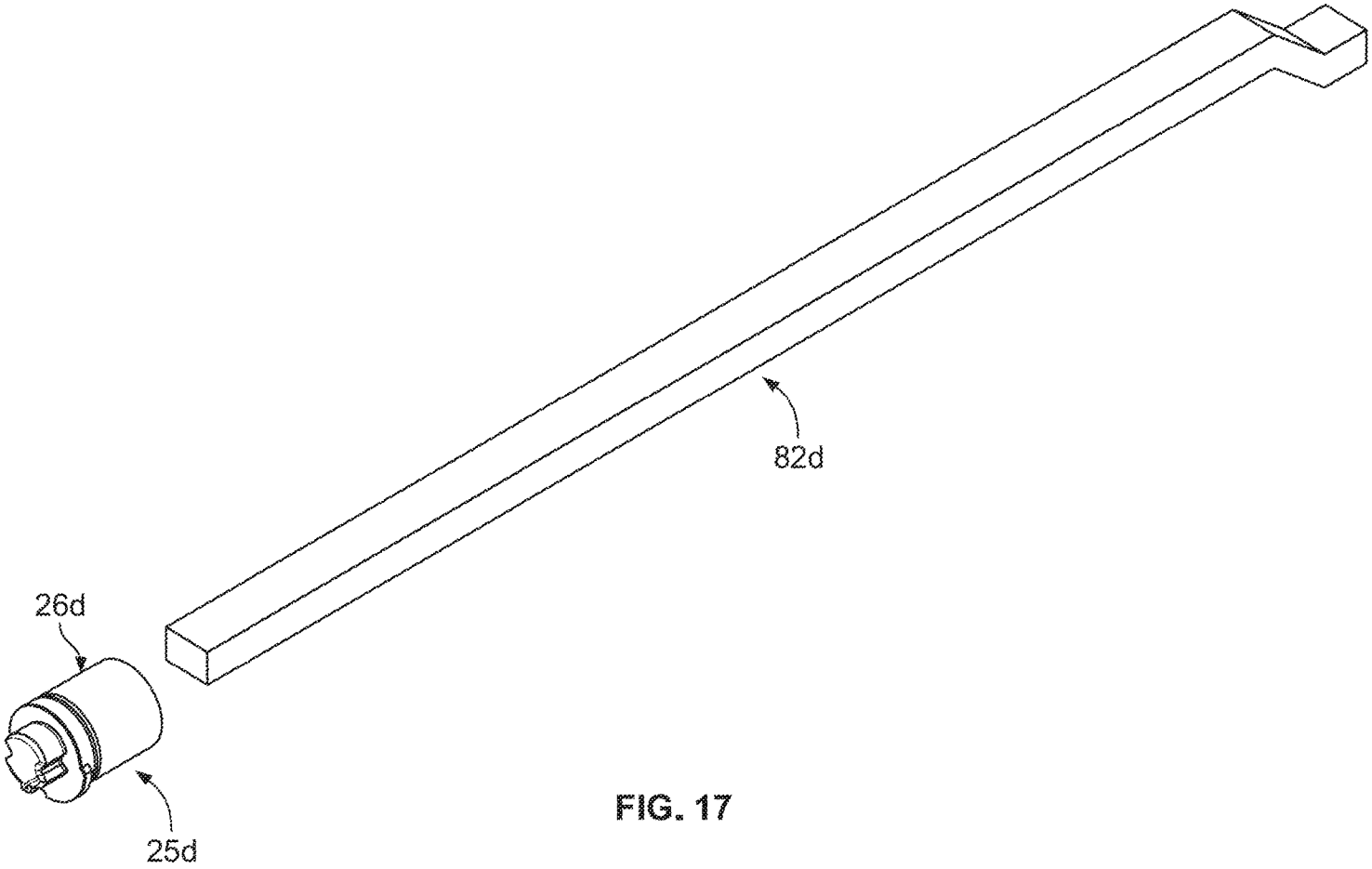
FIG. 17 is a perspective view of an adapter and a locking mechanism, according to one embodiment of the present disclosure.

FIG. 16 shows the adapter 25*c*, a plurality of locking mechanisms 82*a*, 82*b*, 82*c*, and a fastener 83. A single locking mechanism 82*a*, 82*b*, 82*c*, can be positioned around the locking mechanism interface 26*c* of the adapter 25*c*. In some examples, the locking mechanisms 82*a*, 82*b*, 82*c* each include an aperture 84*a*, 84*b*, 84*c* that is configured to be positioned around and secured to the locking mechanism interface 26*c* via the fastener 83. While adapter 25*c* is shown, adapters 25*a*, 25*b*, along with a variety of other adapters having similar locking mechanisms interfaces, can also be used with locking mechanisms 82*a*, 82*b*, 82*c*.

The locking mechanisms 82*a*, 82*b*, 82*c* may be any known locking mechanism that operates with rotational operation. In some examples, the locking mechanisms 82*a*, 82*b*, 82*c* include a locking tab 86 that is configured to engage with a corresponding surface (e.g., a corresponding opposite tab) within the interior of the enclosure 3 to allow the locking mechanism 82 to lock and unlock the enclosure 3. The locking mechanism 82 may be operated to rotate as the key 13 is inserted into the face 32 of the lock core 12 and rotated. In some examples, the locking mechanism 82 can be a bar having an aperture. In such an example, the locking mechanism interface 26 is secured within the aperture of the bar with the fastener 83.

FIG. 16 shows the adapter 25*d* and a locking mechanism 82*d*. In the depicted example, the locking mechanism 82*d* is a bar that is configured to mate with the locking mechanism interface 26*d*. As shown in FIG. 15, the locking mechanism interface 26*d* includes a recess 80. The locking mechanism 82*d* is configured to be positioned within the recess 80 to facilitate rotation transfer between the adapter 25*d* and the locking mechanism 82*d*.

Certain aspects of the present disclosure can relate to:

In one example of the present disclosure, a lock core assembly is disclosed. The lock core assembly includes a body that includes an enclosure mounting interface. The body has a first portion that extends to a first side of the enclosure mounting interface and a second portion that extends to a second side of the enclosure mounting interface opposite the first side. The body defines a housing bore that has an opening defined in the body at the first side. The housing bore further includes lock core retaining features defined therein. The lock core assembly includes a lock core removably positioned within the housing bore and mated with the lock core retaining features. The lock core retaining features are sized and shaped to prevent relative rotation between at least a portion of the lock core and the body. The lock core further includes a rotatable housing interface. The lock core assembly includes a lock core interface positioned within the housing bore. The lock core interface is removably coupled with the housing interface of the lock core. The lock core assembly includes a locking mechanism interface positioned at the second side of the body and in rotational communication with the lock core interface. The locking mechanism interface is positioned at an exterior of the housing bore and is configured to be coupled with a locking mechanism. The housing interface of the lock core is rotationally coupled to the locking mechanism interface by way of the lock core interface.

In another example including the disclosure of any other examples disclosed herein, the lock core interface is disposed on an adapter removably coupled to the second side of the first body.

In another example including the disclosure of any other examples disclosed herein, the locking mechanism interface is disposed on an opposite side of the adapter than the lock core interface.

In another example including the disclosure of any other examples disclosed herein, at least one of the lock core retaining features is a slot defined by a wall of the housing bore, wherein a clip is removably secured within the slot, wherein the clip contacts a portion of the lock core to secure the lock core within the housing bore.

In another example including the disclosure of any other examples disclosed herein, at least one of the lock core retaining features is at least one of a channel and a recess.

In another example including the disclosure of any other examples disclosed herein, at least one of the lock core retaining features is at least one channel, and wherein the lock core includes at least one corresponding projection, wherein the projection and the at least one channel are mated when the lock core is positioned within the housing bore.

In another example including the disclosure of any other examples disclosed herein, the locking mechanism interface is a threaded interface.

In another example including the disclosure of any other examples disclosed herein, the lock core interface is at least one of a recess and a projection, and wherein the housing interface of the lock core is the corresponding opposite at least one of a recess and a projection.

In another example including the disclosure of any other examples disclosed herein, the lock core interface limits the amount of rotation of the housing interface.

In another example including the disclosure of any other examples disclosed herein, the body of the housing includes an exterior flange, an exterior threaded interface, and a nut, wherein the nut is securable to the threaded interface to position the fixed surface between the flange and the nut.

In another example including the disclosure of any other examples disclosed herein, the lock core is rekeyable.

In another example of the present disclosure, an enclosure is disclosed. The enclosure includes a first body selectively coupled to a second body. The enclosure includes a housing coupled to at least one of the first body and the second body. The housing includes a body that includes an enclosure mounting interface. The body has a first portion that extends to a first side of the enclosure mounting interface and a second portion that extends to a second side of the enclosure mounting interface opposite the first side. The body defines a housing bore that has an opening defined in the body at the first side. The housing bore further includes lock core retaining features defined therein. The housing includes a lock core interface positioned within the housing bore. The housing includes a locking mechanism interface positioned at the second side of the body and in rotational communication with the lock core interface. The locking mechanism interface is positioned at an exterior of the housing bore. The enclosure further including a locking mechanism coupled to the locking mechanism interface. The locking mechanism has a locked position and an unlocked position. When in the locked position, the first body is coupled to the second body by way of the locking mechanism, and, when in the unlocked position, the first body and the second body are at least partially uncoupled by way of the locking mechanism. The enclosure includes a lock core removably positioned within the housing bore and mated with the lock core retaining features. The lock core retaining features are sized and shaped to prevent relative rotation between at least a portion of the lock core and the housing body. The lock core includes a rotatable housing interface and the housing interface of the lock core is removably coupled with the lock core interface of the housing. The housing interface of the lock core is rotationally coupled to the locking mechanism interface by way of the lock core interface. Rotation of the lock core housing interface cycles the locking mechanism between the unlocked position and the locked position.

In another example including the disclosure of any other examples disclosed herein, the lock core interface is disposed on an adapter removably coupled to the second side of the first body.

In another example including the disclosure of any other examples disclosed herein, the locking mechanism interface is disposed on an opposite side of the adapter than the lock core interface.

In another example including the disclosure of any other examples disclosed herein, wherein at least one of the lock core retaining features is a slot defined by a wall of the housing bore, wherein a clip is removably secured within the slot, and wherein the clip contacts a portion of the lock core to secure the lock core within the housing bore.

In another example including the disclosure of any other examples disclosed herein, the body of the housing includes an exterior flange, an exterior threaded interface, and a nut, wherein the nut is secured to the threaded interface to position the at least one of the first and second body between the flange and the nut.

In another example of the present disclosure, a housing for a lock core is disclosed. The housing including includes a body that includes an enclosure mounting interface. The body has a first portion that extends to a first side of the enclosure mounting interface and a second portion that extends to a second side of the enclosure mounting interface opposite the first side. The body defines a housing bore that has an opening defined in the body at the first side. The housing bore further includes lock core retaining features defined therein. At least one of the lock core retaining features is a slot defined by a wall of the housing bore. The lock core retaining features are sized and shaped to mate with a lock core to prevent relative movement between at least a portion of the lock core and the body. The housing includes a clip removably secured within the slot. The clip is at least partially positioned within the housing bore. The clip is positioned generally perpendicular to the housing bore axis. The housing includes a lock core interface positioned within the housing bore. The housing includes a locking mechanism interface positioned at the second side of the body and in rotational communication with the lock core interface. The locking mechanism interface is positioned at an exterior of the housing bore. The locking mechanism interface is configured to be coupled with a locking mechanism.

In another example including the disclosure of any other examples disclosed herein, wherein the lock core interface is disposed on an adapter removably coupled to the second side of the first body.

In another example including the disclosure of any other examples disclosed herein, wherein the locking mechanism interface is disposed on an opposite side of the adapter than the lock core interface.

In another example including the disclosure of any other examples disclosed herein, wherein the lock core interface is at least one of a recess and a projection, and wherein the housing interface of the lock core is the corresponding opposite at least one of a recess and a projection.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

We claim:

1. A lock core assembly comprising:

a body having a first portion extending to a first side of the body and a second portion extending to a second side of the body, opposite the first side, the body defining a housing bore having a bore axis, the housing bore having an opening defined in the body at the first side, the housing bore further including lock core retaining features defined therein, wherein at least one of the lock core retaining features is a slot defined by a wall of the housing bore, the body further including an exterior flange;

a nut positionable around the body between the exterior flange and the slot, the nut being configured to securely position a fixed surface between the exterior flange and the nut;

a clip removably secured within the slot so that the nut may pass over the clip while the clip is positioned within the slot, wherein the clip is at least partially positioned within the housing bore, and wherein the clip is positioned generally perpendicular to the housing bore axis;

a lock core removably positioned within the housing bore and including a lock core housing including at least one protrusion mated with the lock core retaining features, wherein the lock core housing and lock core retaining features are cooperatively sized and shaped to prevent relative rotation between the lock core housing and the body, the lock core including an inner assembly rotationally coupled to a rotatable housing interface;

a lock core interface positioned within the housing bore, the lock core interface removably coupled with the housing interface of the lock core and rotatable with the inner assembly and the housing interface; and a locking mechanism interface positioned at the second side of the body and in rotational communication with the lock core interface, the locking mechanism interface being positioned at an exterior of the housing bore and configured to be coupled with a locking mechanism, wherein the housing interface of the lock core is rotationally coupled to the locking mechanism interface by way of the lock core interface.

2. The lock core assembly of claim 1, wherein the lock core interface is disposed on an adapter removably coupled to the second side of the body.

3. The lock core assembly of claim 2, wherein the locking mechanism interface is disposed on an opposite side of the adapter than the lock core interface.

4. The lock core assembly of claim 1, wherein at least one of the lock core retaining features is at least one of a channel and a recess.

5. The lock core assembly of claim 1, wherein at least one of the lock core retaining features is at least one channel, and wherein the lock core housing of the lock core includes at least one corresponding projection, wherein the projection and the at least one channel are mated when the lock core is positioned within the housing bore.

6. The lock core assembly of claim 1, wherein the locking mechanism interface is a threaded interface.

7. The lock core assembly of claim 1, wherein the lock core interface is at least one of a recess and a projection, and wherein the housing interface of the lock core is the corresponding opposite at least one of a recess and a projection.

8. The lock core assembly of claim 1, wherein the lock core interface limits the amount of rotation of the housing interface.

9. The lock core assembly of claim 1, wherein the body includes an exterior threaded interface, wherein the nut is securable to the exterior threaded interface to position the fixed surface between the exterior flange and the nut.

10. The lock core assembly of claim 1, wherein the lock core is rekeyable.

11. The lock core assembly of claim 1, wherein the clip engages a receiving notch of the lock core housing while the clip is positioned within the slot, the receiving notch being adjacent the at least one protrusion.

12. An enclosure comprising:

a first enclosure body selectively coupled to a second enclosure body;

a housing coupled to at least one of the first enclosure body and the second enclosure body, the housing including:

a body having a first portion extending to a first side of the body and a second portion extending to a second side of the body, opposite the first side, the body defining a housing bore having a bore axis, the housing bore having an opening defined in the body at the first side, the housing bore further including lock core retaining features defined therein, wherein at least one of the lock core retaining features is a slot defined by a wall of the housing bore, the body further including an exterior flange;

a nut positionable around the body between the exterior flange and the slot, the nut being configured to securely position at least one of the first and second enclosure bodies between the exterior flange and the nut;

a clip removably secured within the slot so that the nut may pass over the clip while the clip is positioned within the slot, wherein the clip is at least partially positioned within the housing bore, and wherein the clip is positioned generally perpendicular to the housing bore axis;

a lock core interface positioned within the housing bore; and a locking mechanism interface positioned at the second side of the body and in rotational communication with the lock core interface, the locking mechanism interface being positioned at an exterior of the housing bore;

a locking mechanism coupled to the locking mechanism interface, wherein the locking mechanism has a locked position and an unlocked position, wherein, when in the locked position, the first enclosure body is coupled to the second enclosure body by way of the locking mechanism, and wherein, when in the unlocked position, the first enclosure body and the second enclosure body are at least partially uncoupled by way of the locking mechanism; and a lock core removably positioned within the housing bore and including a lock core housing including at least one protrusion mated with the lock core retaining features, wherein the lock core retaining features are sized and shaped to prevent relative rotation between the lock core housing of the lock core and the housing body while allowing at least a portion of the lock core to rotate relative to the lock core housing, the lock core including an inner assembly rotationally coupled to a rotatable housing interface, wherein the housing interface of the lock core is removably coupled with the lock core interface of the housing, wherein the housing interface of the lock core is rotationally coupled to the locking mechanism interface by way of the lock core interface, and wherein rotation of the lock core housing interface cycles the locking mechanism between the unlocked position and the locked position.

13. The enclosure of claim 12, wherein the lock core interface is disposed on an adapter removably coupled to the second side of the body.

14. The enclosure of claim 13, wherein the locking mechanism interface is disposed on an opposite side of the adapter than the lock core interface.

15. The enclosure of claim 12, wherein the body includes an exterior threaded interface, wherein the nut is secured to the exterior threaded interface to position the at least one of the first and second enclosure bodies between the exterior flange and the nut.

16. The enclosure of claim 12, wherein the lock core is rekeyable.

17. A housing for a lock core comprising:

a body having a first portion extending to a first side of the body and a second portion extending to a second side of the body, opposite the first side, the body defining a housing bore having a bore axis, the housing bore having an opening defined in the body at the first side, the housing bore further including lock core retaining features defined therein, wherein at least one of the lock core retaining features is a slot defined by a wall of the housing bore, wherein the lock core retaining features are sized and shaped to mate with at least one protrusion of a lock core housing of a lock core to prevent relative movement between the lock core housing of the lock core and the body while allowing at least a portion of the lock core to rotate between locked and unlocked positions, the body further including an exterior flange and a threaded interface disposed on the body;

a nut removably secured to the threaded interface around the body between the exterior flange and the slot, the nut being configured to securely position a fixed surface between the exterior flange and the nut;

a clip removably secured within the slot so that the nut may pass over the clip while the clip is positioned within the slot, wherein the clip is at least partially positioned within the housing bore, and wherein the clip is positioned generally perpendicular to the housing bore axis;

a lock core interface positioned within the housing bore; and a locking mechanism interface positioned at the second side of the body and in rotational communication with the lock core interface, the locking mechanism interface being positioned at an exterior of the housing bore, and wherein the locking mechanism interface is configured to be coupled with a locking mechanism.

18. The housing of claim 17, wherein the lock core interface is disposed on an adapter removably coupled to the second side of the body.

19. The housing of claim 18, wherein the locking mechanism interface is disposed on an opposite side of the adapter than the lock core interface.

20. The housing of claim 17, further comprising a lock core removably positioned within the housing bore and mated with the lock core retaining features, the lock core including a rotatable housing interface, wherein the housing interface of the lock core is removably coupled with the lock core interface of the housing, wherein the lock core interface is at least one of a recess and a projection, and wherein the housing interface of the lock core is the corresponding opposite at least one of a recess and a projection.

* * * * *